US008136585B2

(12) United States Patent
Cherewyk

(10) Patent No.: US 8,136,585 B2
(45) Date of Patent: Mar. 20, 2012

(54) RADIAL BALL INJECTING APPARATUS FOR WELLBORE OPERATIONS

(75) Inventor: Boris (Bruce) P Cherewyk, Calgary (CA)

(73) Assignee: Isolation Equipment Services, Inc., Red Deer (CA)

( * ) Notice: Subject to any disclaimer, the term of this patent is extended or adjusted under 35 U.S.C. 154(b) by 195 days.

(21) Appl. No.: 12/778,945

(22) Filed: May 12, 2010

(65) Prior Publication Data

US 2010/0288496 A1 Nov. 18, 2010

Related U.S. Application Data

(60) Provisional application No. 61/177,395, filed on May 12, 2009.

(51) Int. Cl.
*E21B 33/13* (2006.01)

(52) U.S. Cl. ..... 166/75.15; 166/284; 15/104.062; 137/268

(58) Field of Classification Search ..... 166/285, 166/70, 75.15; 137/268; 15/104.062
See application file for complete search history.

(56) References Cited

U.S. PATENT DOCUMENTS

| | | | | |
|---|---|---|---|---|
| 3,063,079 | A * | 11/1962 | Bergman et al. | 15/104.062 |
| 4,132,243 | A | 1/1979 | Kuus | |
| 4,577,614 | A | 3/1986 | Schoeffler | |
| 4,759,469 | A | 7/1988 | Lowrance et al. | |
| 7,552,763 | B2 * | 6/2009 | Claxton | 166/75.15 |
| 7,571,773 | B1 * | 8/2009 | West et al. | 166/373 |
| 2005/0184083 | A1 | 8/2005 | Diaz et al. | |

OTHER PUBLICATIONS

Webpage product details found at www.siismithservices.com for a top Drive Cementing manifold having a integral ball drop featuring independent ball drop indicators (2007).

* cited by examiner

*Primary Examiner* — Giovanna Wright
(74) *Attorney, Agent, or Firm* — Sean W Goodwin

(57) ABSTRACT

An apparatus for successively releasing balls into a wellbore during wellbore operations is disclosed. The apparatus has a radial housing having at least one radial ball array having two or more radial bores. Each radial bore houses a ball cartridge adapted to receive and release balls and an actuator for operably aligning or misaligning the ball cartridge with an axial bore in fluid communication with the wellbore. The ball cartridge is moveable along the radial bore and is operable between an aligned position, for releasing a ball and a misaligned position for storing the ball.

18 Claims, 22 Drawing Sheets

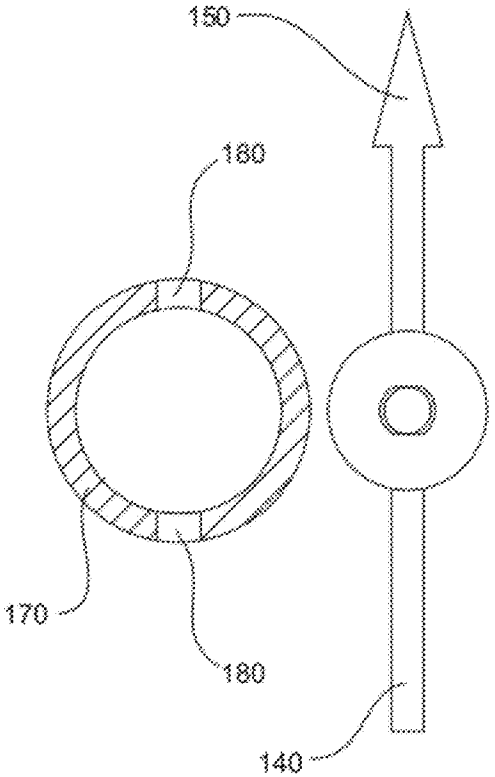
Fig. 6A'
Fig. 6A''
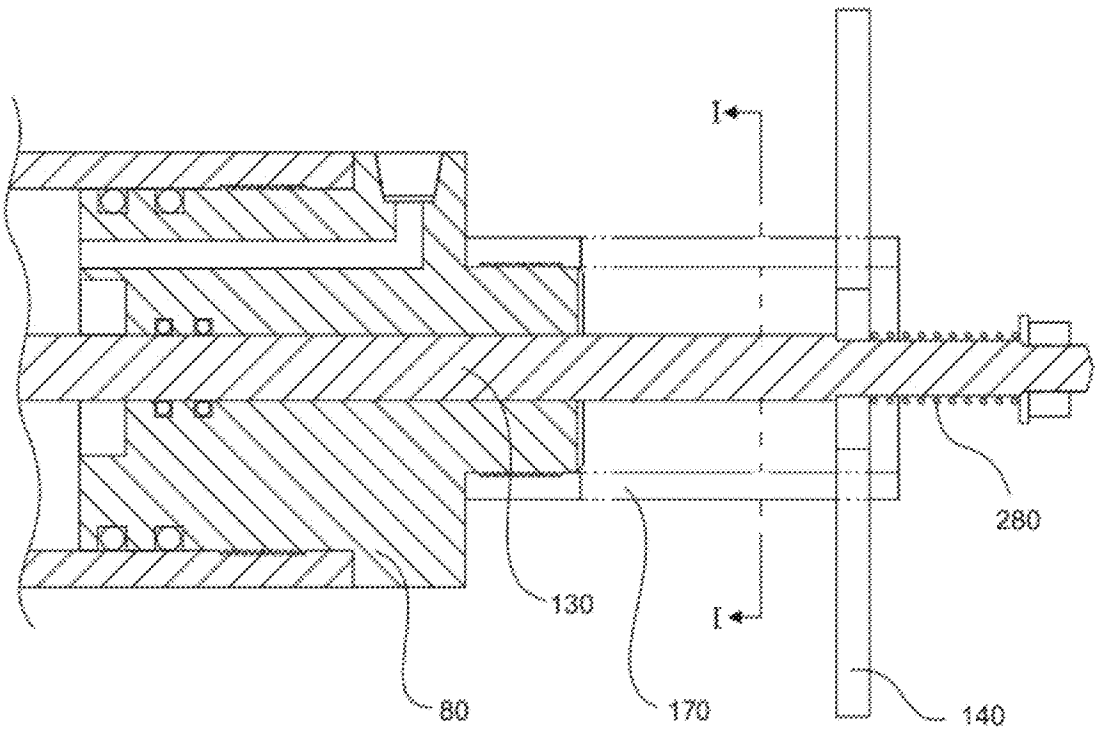
Fig. 6A

RADIAL BALL INJECTING APPARATUS FOR WELLBORE OPERATIONS

CROSS REFERENCE TO RELATED APPLICATIONS

This application claims the benefits under 35 U.S.C. 119(e) of the U.S. Provisional Application Ser. No. 61/177,395, filed on May 12, 2009, the entirety of which is incorporated herein by reference.

FIELD OF THE INVENTION

This invention relates generally to an apparatus and method for injecting balls into a wellbore, such as drop balls, frac balls, packer balls and other balls, for interacting with downhole tools, such as activating tools that allow select zones or zone intervals in the wellbore to be stimulated. More particularly, the apparatus and method uses a radial housing having at least one radial ball array having one or more radial bores for controllably receiving, storing and releasing balls into a fluid stream which is pumped into the wellbore.

BACKGROUND OF THE INVENTION

It is known to conduct fracturing or other stimulation procedures in a wellbore by isolating zones of interest, (or intervals within a zone), in the wellbore, using packers and the like, and subjecting the isolated zone to treatment fluids, including liquids and gases, at treatment pressures. In a typical fracturing procedure for a cased wellbore, for example, the casing of the well is perforated to admit oil and/or gas into the wellbore and fracturing fluid is then pumped into the wellbore and through the perforations into the formation. Such treatment opens and/or enlarges drainage channels in the formation, enhancing the producing ability of the well. For open holes that are not cased, stimulation is carried out directly in the zones or zone intervals.

It is typically desired to stimulate multiple zones in a single stimulation treatment, typically using onsite stimulation fluid pumping equipment. A series of packers in a packer arrangement is inserted into the wellbore, each of the packers located at intervals for isolating one zone from an adjacent zone. It is known to introduce a ball into the wellbore to selectively engage one of the packers in order to block fluid flow therethrough, permitting creation of an isolated zone uphole from the packer for subsequent treatment or stimulation. Once the isolated zone has been stimulated, a subsequent ball is dropped to block off a subsequent packer, uphole of the previously blocked packer, for isolation and stimulation thereabove. The process is continued until all the desired zones have been stimulated. Typically the balls range in diameter from a smallest ball, suitable to block the most downhole packer, to the largest diameter, suitable for blocking the most uphole packer.

At surface, the wellbore is fit with a wellhead including valves and a pipeline connection block, such as a frachead, which provides fluid connections for introducing stimulation fluids, including sand, gels and acid treatments, into the wellbore. Conventionally, operators manually introduce balls to the wellbore through an auxiliary line, coupled through a valve, to the wellhead. The auxiliary line is fit with a valved tee or T-configuration connecting the wellhead to a fluid pumping source and to a ball introduction valve. The operator closes off the valve at the wellhead to the auxiliary line, introduces one ball and blocks the valved T-configuration. The pumping source is pressurized to the auxiliary line and the wellhead valve is opened to introduce the ball. This procedure is repeated manually, one at a time, for each ball. This operation requires personnel to work in close proximity to the treatment lines through which fluid and balls are pumped at high pressures and rates. The treatment fluid is typically under high pressure and gas energized, and may be corrosive which is very hazardous.

Aside from being a generally hazardous practice, other operational problems may occur, such as valves malfunctioning and balls becoming stuck and not being pumped downhole. These problems have resulted in failed well treatment operations, requiring re-working which is very costly and inefficient. At times re-working or re-stimulating of a well formation following an unsuccessful stimulation treatment may not be successful, which results in production loss.

Other alternative methods and apparatus for the introduction of the balls have included an array of remote valves positioned onto a multi-port connection at the wellhead with a single ball positioned behind each valve. Each valve requires a separate manifold fluid pumper line and precise coordination both to ensure the ball is deployed and to ensure each ball is deployed at the right time in the sequence, throughout the stimulation operation. The multi-port arrangement, although workable, has proven to be very costly and inefficient. Further, this arrangement is dangerous to personnel due to the multiplicity of lines under high pressure connected to the top the wellhead during the stimulation operation. The multiplicity of high pressure lines also logistically limits the amount of balls that can be dropped due to wellhead design and available ports.

Larger packer balls also require specialty large bore launchers and related fracturing iron or fracturing piping which, in many cases, are not readily available and costly to procure. For example 3" fracturing fluid piping is common but for larger balls 4" and even 5" pipe is required, typically having lower pressure ratings and significantly increasing the weight of the piping assembly and related high pressure capable valves and fittings. Thus, the burden to use external piping for launching larger balls quickly becomes unworkable.

It is known to feed a plurality of perforation-sealing balls using an automated device as set forth in U.S. Pat. No. 4,132,243 to Kuus. Same-sized balls are used for sealing perforations and are able to be fed one by one from a stack of balls. The apparatus appears limited to same-sized balls and there is no positive identification whether a ball was successfully indexed from the stack for injection.

Applicant has set forth a more reliable injector as set forth in published U.S. Patent Application 2008/0223587, published on Sep. 18, 2008. While addressing many of the above issues, the apparatus still retains a measure of mechanical complexity.

In another prior art arrangement, such as that set forth in FIG. 1, a vertically stacked manifold of pre-loaded balls is oriented in a bore above the wellbore of a wellhead and frac head. Each ball is temporarily supported by a rod or finger. Each finger is sequentially actuated to withdraw from the bore when required to release or launch the next largest ball. As the balls are already stacked in the bore, the lowest ball (closest to the wellbore) is necessarily the smallest ball.

It is not uncommon for a ball to be damaged or to disintegrate upon arrival at the downhole tool requiring a replacement ball or one of the same diameter to be reloaded and launched again. In the apparatus of FIG. 1, the entire apparatus must be depressurized, removed and reloaded to get a small ball under the remaining loaded balls. This requires time consuming and properly managed procedures to maintain safe control in a hazardous environment and to complete testing and re-pressurization procedures upon reinstallation to the wellhead.

More particularly, on occasions, a packer ball can be damaged while enroute to the packer. Further, pumping of displacement fluid through unit can also damage or scar balls, especially if the displacement fluid is sand-laden fracturing fluid. Damaged and scarred packer balls typically fail to isolate the zone requiring an operator to then drop an identical ball down the bore of the injector. The apparatus bore of FIG. 1 is restricted, and therefore requires the entire unit to be removed, the replacement ball dropped, the unit reassembled, and pressure tested. This is extremely inefficient, time consuming, costly and can adversely compromise the treatment.

There remains a need for a safe, efficient and remotely operated apparatus and mechanism for introducing balls to a wellbore.

SUMMARY OF THE INVENTION

The present invention teaches a radial ball injection apparatus and method. The radial ball injector has a housing, adapted to be supported on a wellhead structure having a wellbore. Each radial housing has an axial bore and at least one radial ball array having two or more radial bores extending radially away from the axial bore and fluidly connected therewith. The axial bore is aligned with the wellbore. Each radial bore houses a ball cartridge. Each radial bore has an actuator for actuating the ball cartridge. The ball cartridge is movable along the radial bore for extending into and retracting from the axial bore. The ball cartridge receives, stores, and releases balls.

More than one radial ball array can be vertically stacked one on top of another to increase the number of balls available for wellbore operations. A radial ball array can be housed in a radial housing. Alternatively, more than two radial ball arrays can be vertically arranged within a radial housing. In each case, the axial bore of each of the radial housing is aligned with one another and with the wellbore.

In a broad aspect of the invention a ball injecting apparatus is provided for releasing balls into a wellhead having a wellbore. The apparatus comprises a housing adapted to be supported by the wellhead. The housing has an axial bore therethrough and at least one radial ball array having two or more radial bores extending radially away from the axial bore and in fluid communication therewith, the axial bore being in fluid communication and aligned with the wellbore.

Each radial bore has a ball cartridge for storing a ball and an actuator for moving the ball cartridge along the radial bore. The actuator reciprocates the ball cartridge for operably aligning with the axial bore for releasing the stored ball and operably misaligning from the axial bore for clearing the axial bore.

Using the radial ball injecting apparatus or injector, should a ball of the required size for the particular step in the wellbore operation be lost or damaged for some reason, another ball can be provided without removal of the radial ball injecting apparatus from the wellhead structure. The wellbore or any of the ball cartridges of any of the radial bores can be accessed through the axial bore at anytime. The radial housing is isolated from the wellhead, the axial bore depressurized, and the particular ball cartridge reloaded with a replacement ball. Alternatively, as operations are already ongoing, the replacement ball can be directly dropped down the axial bore to rest on a closed gate of a valve isolating the radial housing from the wellhead, fracturing lines and/or wellbore. There is no interference by any other of the ball injection apparatus as the axial bore of each radial housing is open and unobstructed, free of balls or ball cartridges storing balls. With the exception of when the ball cartridge is receiving or releasing a ball, the axial bore remains otherwise free and unobstructed.

In another embodiment, and wherein the balls are loaded in a top-down (small to large) order, should there be an early malfunction of any ball cartridge or actuator, then the remaining, successive and independent ball cartridges remain available to continue operations with the next sequential size of ball. If a malfunctioning ball cartridge or an actuator block the axial bore then, due to the top-down arrangement, the axial bore therebelow remains open for continuing with the next sizes of balls using a next lower radial ball array.

The apparatus enables a method of successively dropping balls into the wellbore. A radial ball injector is provided for connection to the wellbore, the ball injector having at least one radial ball array having two or more radial bores extending radially away from the axial bore and in fluid communication therewith, the axial bore being in fluid communication and aligned with the wellbore. The method includes storing a ball in each of two or more of the radial bores with the ball operably misaligned from the axial bore; and as required by the particular wellbore operation, actuating a ball from one of the two or more radial bores for operably aligning the ball with the axial bore for release into the wellbore, and repeating the actuating of a successive ball from each other of the two of more radial bores.

BRIEF DESCRIPTION OF THE DRAWINGS

FIG. 6A is a partial cross-sectional side view of an actuator of an embodiment illustrating the position of the indicator and orientation of the arrow prior to the ball cartridge being actuated into alignment with the axial bore;

FIG. 6A' is a cross-sectional view of a guide tube and associated slots along the lines I-I in FIG. 6A FIG. 6A" is a schematic representation of the indicator in FIG. 6A illustrating that the open side of the ball cartridge in FIG. 6A is oriented to face uphole;

FIG. 6D" is a schematic representation of the indicator in FIG. 6D illustrating that the indicator can be rotated in either direction

FIG. 6E" is a schematic representation of the indicator in FIG. 6A illustrating that the open side of the ball cartridge is oriented to face downhole;

FIG. 10A is a side cross-sectional view of a ball cartridge and FIG. 10B is an end cross-sectional view of FIG. 10A along lines II-II. FIG. 10C is an end cross-sectional view of FIG. 10A along lines III-III illustrating an optional flow relief area removed from the end wall 72;

DETAILED DESCRIPTION OF THE INVENTION

Figure 2:
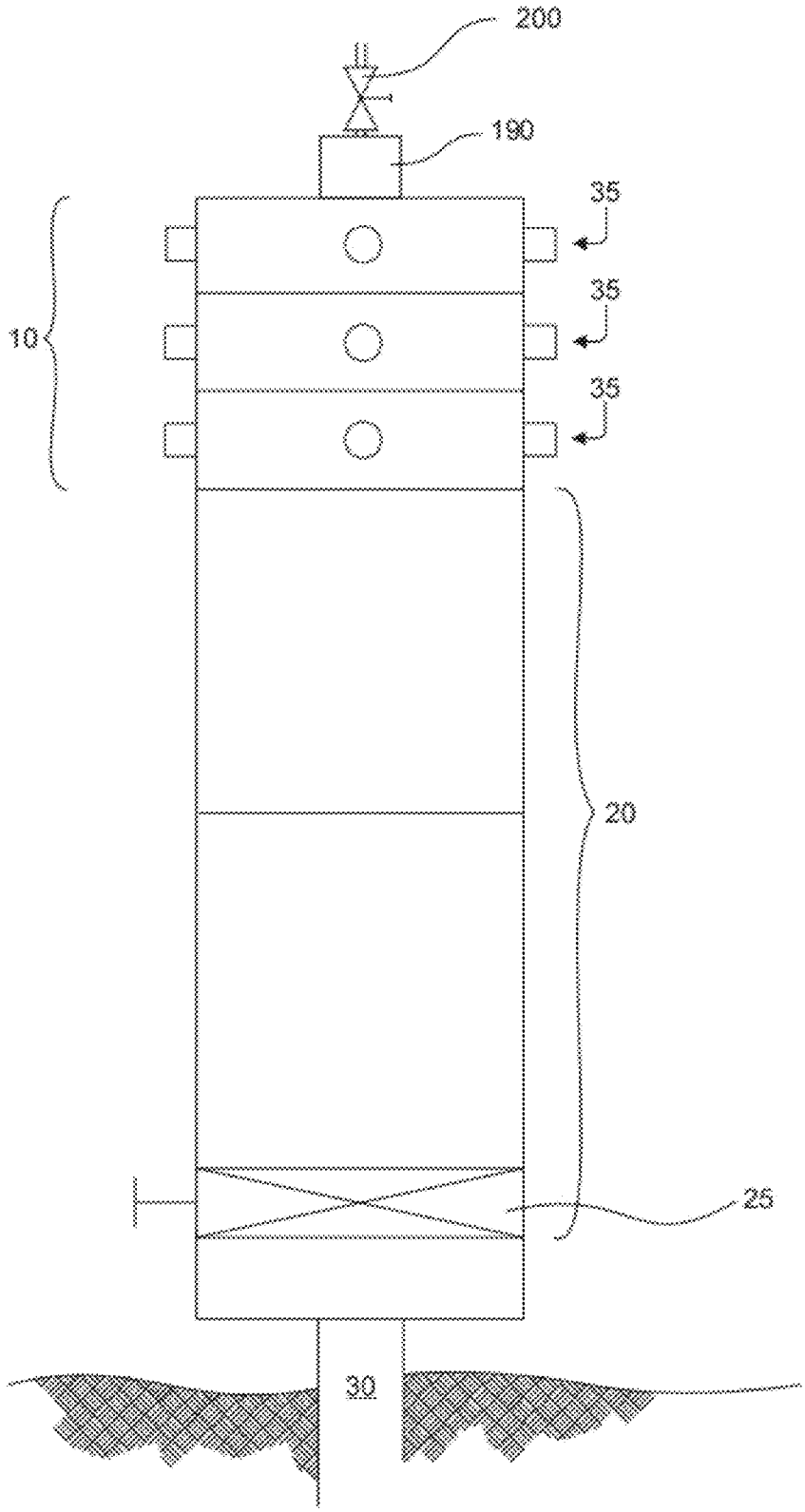
FIG. 2 is a schematic side view of an embodiment of the present invention illustrating a ball injecting apparatus having three radial housing stacked vertically one on top of another, the ball injecting apparatus supported on a wellhead structure on a wellhead.

With reference to FIG. 2 and in accordance to embodiments of the invention, the radial ball injecting apparatus or injector 10 receives and releases balls, including drop balls, frac balls, packer balls, and the like, for isolating zones of interest during wellbore operations such as fracturing. The injector 10, supported on a wellhead structure 20 having a wellbore 30. The wellhead structure 20 can include a high pressure wellhead or a frac head and a wellhead valve 25.

The injector 10 has an axial bore 50 in fluid communication with the wellbore 30. The injector 10 comprises a housing 40 having an axial bore 50 and at least one radial ball array 35 having two or more radial bores 60 in fluid communication with the axial bore 50 for selectively making two or more balls available to the axial bore 50. Several of the radial ball arrays 35 can be arranged vertically within one radial housing 40, or one or more of the radial ball arrays 35 can be housed in a single radial housing 40 and vertically by stacked one on top of another for increasing the number of available balls.

The injector 10 is pre-loaded with balls and installed on the wellhead structure 20 or can be loaded with balls after installation.

Figure 3:
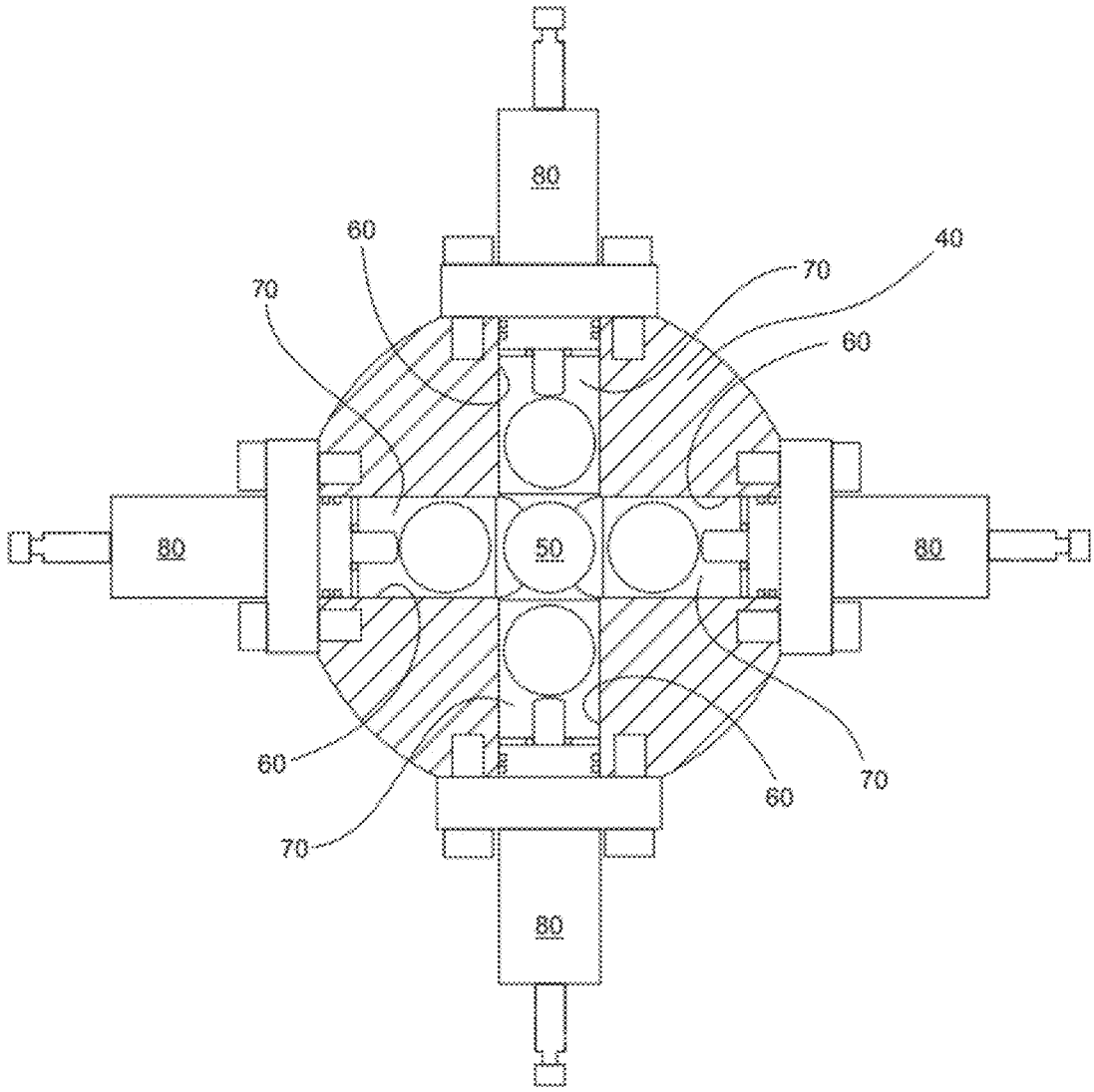
FIG. 3 is a top cross-sectional view of an embodiment of the present invention illustrating a radial housing having a single radial ball array. The radial ball array is illustrated to show four radial bores, and related ball cartridges and actuators fit thereto.
Figure 5A:
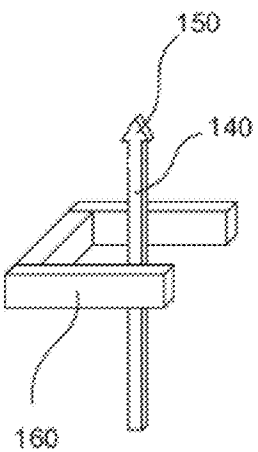
FIGS. 5A to 5D are schematic representations of an indicator of an embodiment of the present invention illustrating an arrow on the indicator that indicates the orientation of the ball cartridge during the loading, storing and releasing of the ball.

As shown in FIG. 3, each radial housing 40 comprises an axial bore 50 therethrough for alignment with the wellbore 30 and a radial ball array 35. Other than during loading of balls or releasing of balls, the axial bore 50 remains clear or unobstructed regardless of the numbers of arrays of radial bores 60.

The two or more radial bores 60 extend radially from the axial bore 50 and are in fluid communication therewith. The embodiment illustrated in FIG. 3 shows a radial housing 40 having a radial ball array of four radial bores 60 oriented at 90 degrees from one another. In other embodiments (not shown), the radial housing 40 can have three, five or more radial bores 60 in a radial ball array, depending upon their size. Smaller radial bores 60 afford more room for an increased number of radial bores 60, but do not afford room for larger balls. Conversely, larger radial bores 60 afford room for larger balls, but does not afford room for an increased number of radial bores 60.

Figure 4A:
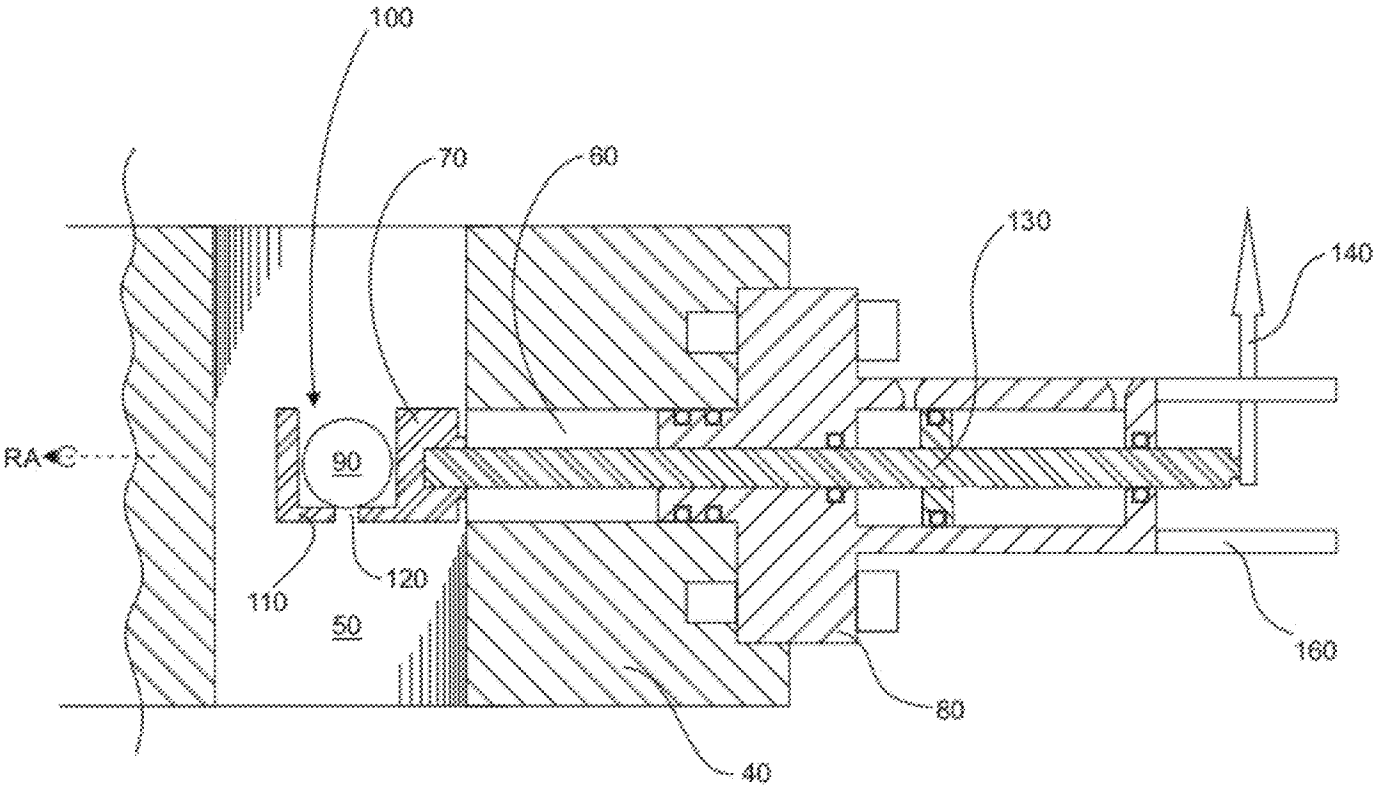
FIG. 4A is a partial cross-sectional side view of the radial housing of an embodiment of the present invention illustrating a ball cartridge, in its receiving position, in alignment with an axial bore of the radial housing being oriented to face uphole. A ball is shown seated in the ball cartridge.
Figure 5B:
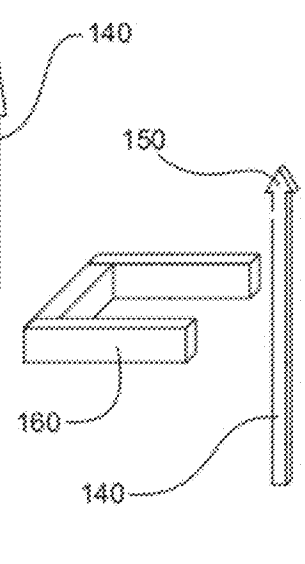

For selectively manipulating a ball associated with each radial bore 60, a ball cartridge 70 and an actuator 80 are provided for each radial bore 60. The ball cartridge 70 is axially operable between an operably aligned and an operably misaligned position. As shown in FIG. 4A, when operably aligned, the ball cartridge is located within the axial bore for receiving and for releasing a ball. In an embodiment, the cartridge extends substantially across the axial bore 50 for receiving a ball during loading or for releasing a ball during operations (shown in FIG. 4D). The ball cartridge 70 can extend substantially across the axial bore 50 to prevent a ball from dropping past the operably aligned ball cartridge 70 during loading of a ball.

Figures 4C, 5C:
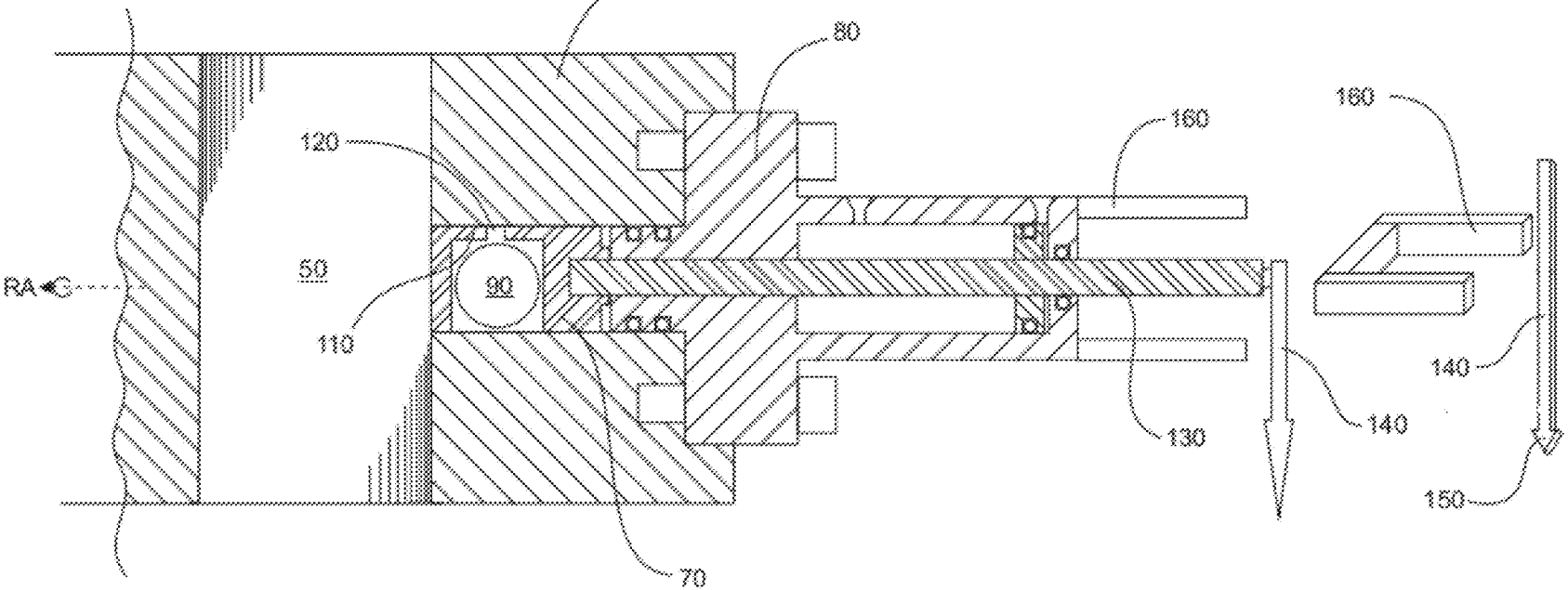
FIG. 4C is a partial cross-sectional side view of the radial housing in accordance to FIGS. 4A and 4B, illustrating the ball cartridge in its standby position, having been rotated 180 degrees to be oriented to face downhole.
Figure 5D:
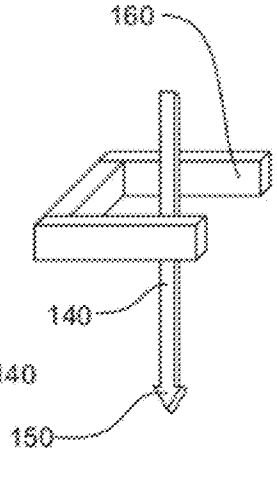

As shown in FIG. 4C, in the misaligned position, the ball cartridge 70 is retracted into its respective radial bore 60, fully clearing the axial bore 50 and safely housing the ball from accidental release into the axial bore 50.

In one embodiment, the ball cartridge 70 is rotationally operable between a receiving position for receiving balls from above and a releasing position for releasing balls down towards the wellbore 30.

The actuator 80, such as a hydraulic ram or cylinder, reciprocates the ball cartridge 70 along its radial bore 60 between the operably aligned and operably misaligned positions. In the aligned position, the actuator 80 positions the ball cartridge 70 in alignment with the axial bore 50 for receiving and releasing balls. In the operably misaligned position, the actuator 80 positions the ball cartridge out of alignment, misaligned, from the axial bore 60, substantially completely retracted from the axial bore, clearing the axial bore 50 and storing the balls within the radial bore 60.

During normal fracturing operations, the ball cartridge 70 is normally securely positioned within the radial bore 60 for storing the balls. Thus, an open and unobstructed axial bore 50 allows an operator to have unhindered access to the wellbore 30 during normal fracturing operations.

Figure 8:
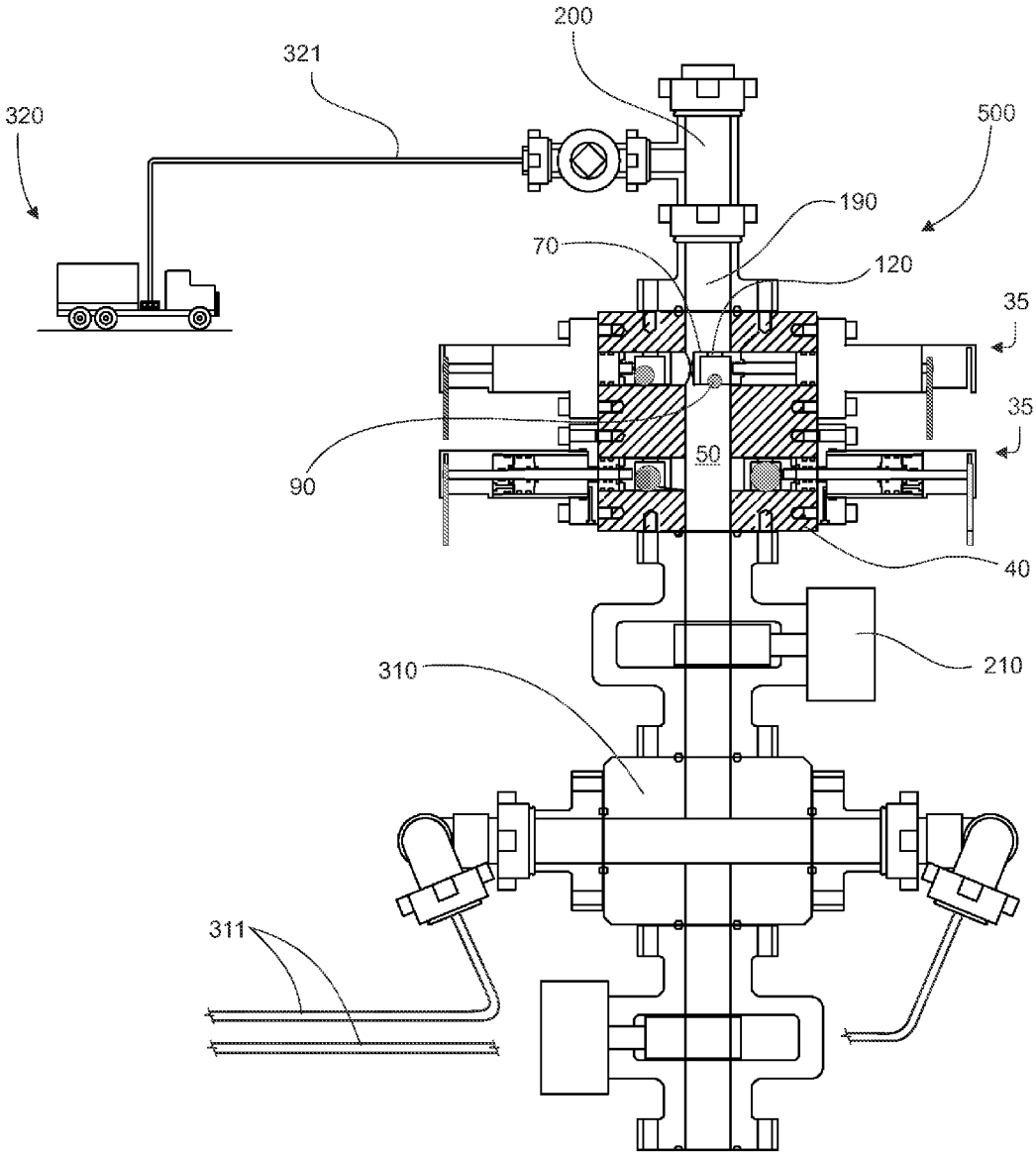
FIG. 8 is a schematic side view of an embodiment of the present invention illustrating a ball injecting apparatus having two levels of radial bores, an auxiliary pumping line fluidly connected to the apparatus, and the apparatus being isolated from a fracturing head by a remote launcher valve.

There are typically at least as many radial bores 60 as there are balls required for a particular wellbore operation. A radial housing 40 of compact height can be provided with one or more radial ball arrays 35 having two or more radial bores 60. In an instance of a radial housing 40 having only one radial ball array 35, that radial ball array 35 would normally have two or more radial bores 60 for providing two or more balls. As shown in FIG. 8, two radial ball arrays 35 are shown in one radial housing 40. Alternatively, as shown in FIG. 2, more than one radial housing 40, each housing 40 having one radial ball array 35, can be affixed vertically, stacked on top of one another for providing successive radial housings 40, 40, 40 so to increase the number of available balls.

Figure 1:
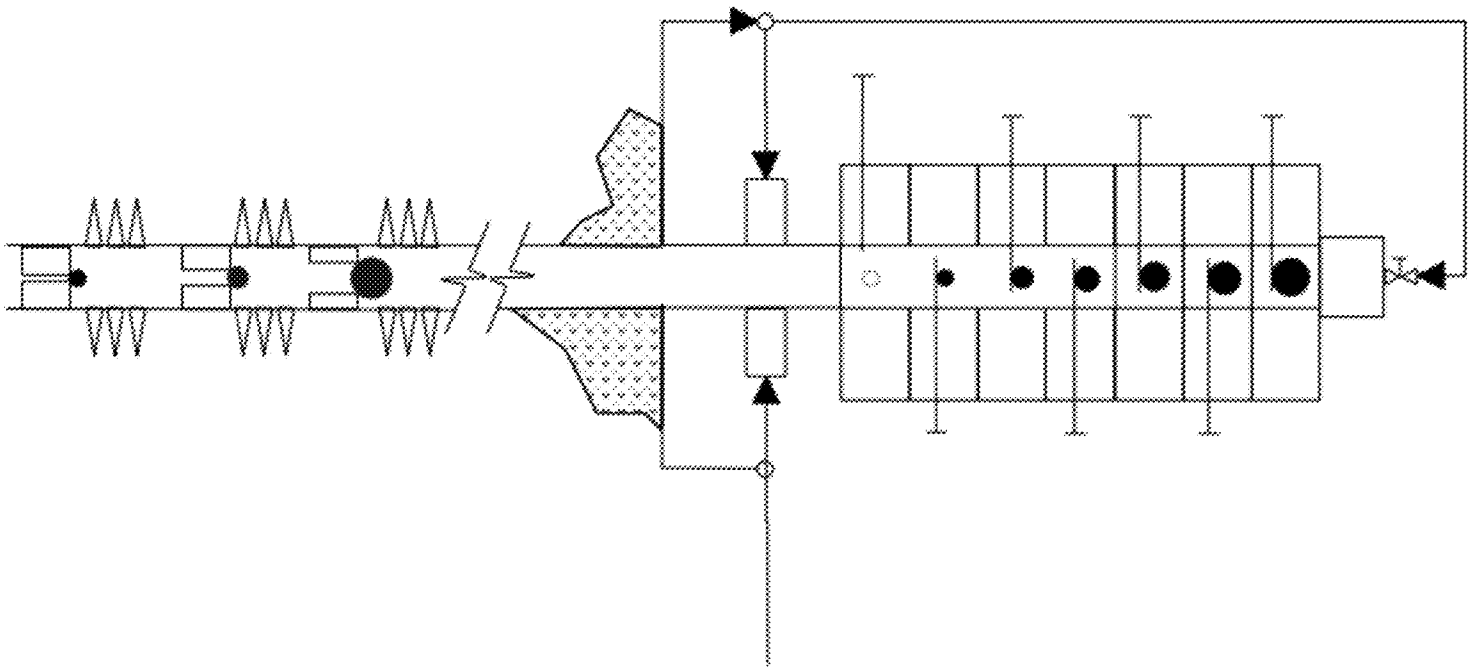
Fig. 1 Prior Art
FIG. 1 is schematic view of a prior art apparatus implementing a plurality of pre-loaded balls for bottom-up injection, the balls supported on a plurality of finger actuators.

By placing two, three, four or more radial bores 60 in the same radial ball array 35, significant height savings are achieved. In otherwords, where the prior art apparatus of FIG. 1 requires four vertical stacks of ball injection apparatus for providing four balls, the structure of embodiments of the invention need only to consume the height of one array of radial bores 60 for enabling four or even more balls. Despite each housing 40 having minimum physical size constraints on height to ensure compliance with access and pressure ratings, a comparable compact ball injector can achieve a compact height.

For example, a typical operation may require a total of eight (8) balls to be dropped. Using an injector 10 having two vertically spaced arrays of four radial bores 60, requires only 19 inches in height, which is about one half the height of the prior art apparatus of FIG. 1. A compact height results in a lower profile of the ball injector 10 allowing for easier access to the injector 10 as well as reducing the strain applied to the entire wellhead 20. Moment forces imposed on the wellhead can be considerable and thus a shorter wellhead is stronger and safer. A ninth ball can be employed if introduced through the axial bore 50 for initially resting on a closed remote valve between the radial housing and the wellbore 30.

With reference to FIGS. 4A to 4D, each ball cartridge 70 is actuated to reciprocate, extending into and in operable alignment with the axial bore 50 for receiving or releasing a ball and retracting into the radial bore 60 for operable misalignment with the axial bore 50 for clearing the axial bore 50 and storing and preventing a ball from being prematurely released or launched into the wellbore 30. For receiving a ball and storing the ball before use, the ball cartridge 70 is adapted to support the ball 90 therein.

Figure 4B:
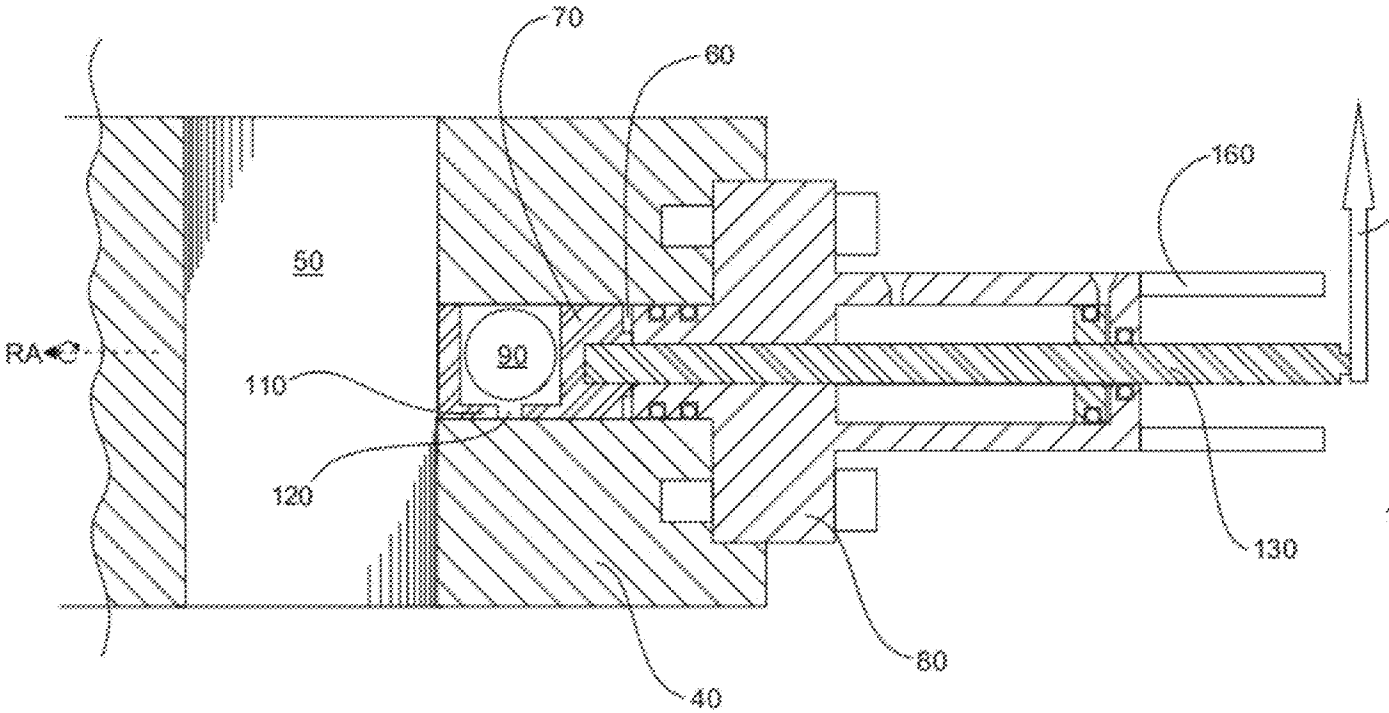
FIG. 4B is a partial cross-sectional side view of the radial housing in accordance to FIG. 4A, illustrating the misalignment of the ball cartridge with the axial bore, and being retracted into a radial bore.

As shown in FIG. 4A in its receiving position, the ball cartridge 70 is extended into the axial bore 50 in alignment therewith. As shown in FIG. 4B, once ball 90 is loaded through the axial bore 50 and seated in the ball cartridge 70, the ball cartridge 70 is misaligned by retraction from the axial bore 50 into a standby position. As shown in FIG. 4C, the ball cartridge 70 can be rotated for storing ball 90 within the radial bore 60, yet immediately available for release into the axial bore 50 when actuated to the aligned position. A person of ordinary skill in the art would understand that the radial bore 60 should be of sufficient size to allow rotation of its ball cartridge 70 therein. One approach is to implement a cylindrical radial bore 60 and cylinder ball cartridge 70.

Figure 4D:
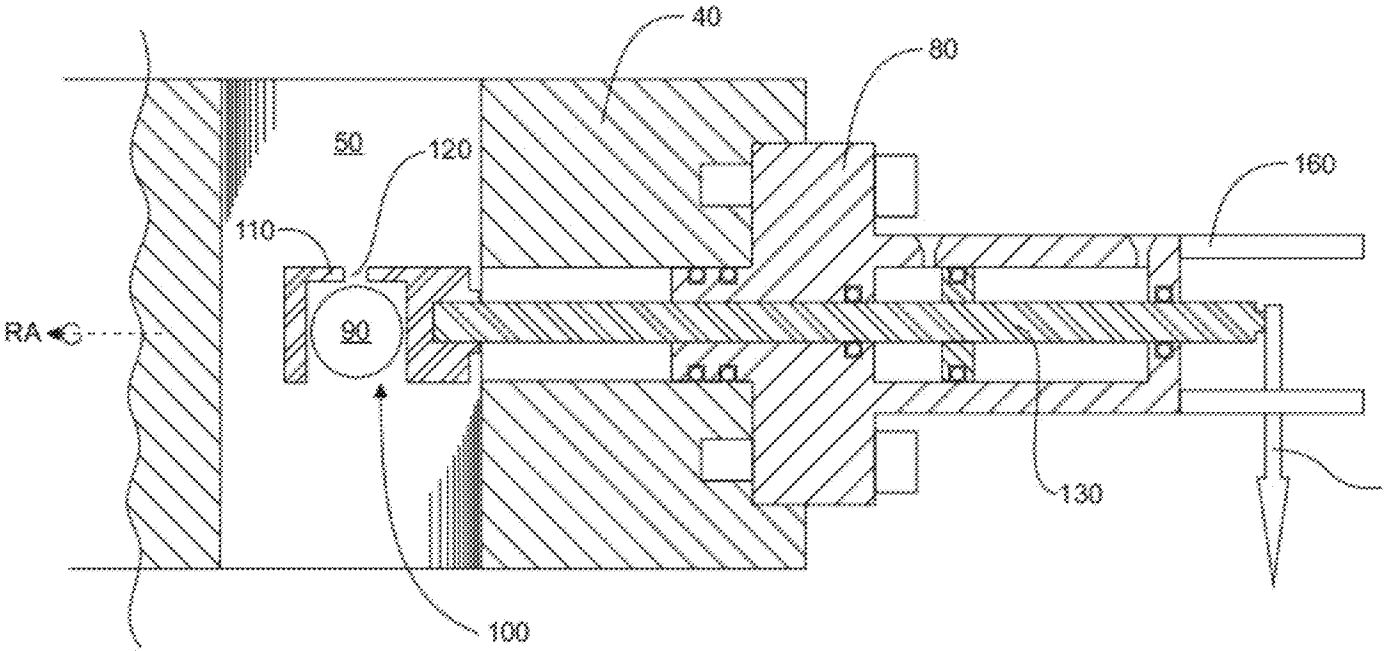
FIG. 4D is a partial cross-sectional side view of the radial housing in accordance to FIGS. 4A to 4C, illustrating the ball cartridge in its releasing position, being in alignment with the axial bore and being oriented to face downhole.

As shown in FIG. 4D, for releasing ball 90 during wellbore operations, the ball cartridge 70 is extended into and operably aligned with the axial bore 50 to release the ball 90. Each ball cartridge 70 is configured for receiving an individual ball 90 for loading therein and subsequently releasing an individual ball 90.

As shown in FIGS. 5A to 5D, 10A and 10B the ball cartridge 70 comprises a cup-like body for manipulating the ball during the ball cartridge's reciprocating movement along the radial bore 60. The ball cartridge 70 has at least constraining end walls 71,72 for retaining the ball within the ball cartridge 70 during reciprocating movement. The ball cartridge 70 has some form of lateral restraining structure 73,73 and an open side 100. The open side 100 permits receiving and releasing of its respective ball 90, and an opposing supporting side 110 for supporting the ball 90 such as during loading. As shown, the ball cartridge 70 is a cup-like device which is alternately oriented uphole for receiving a ball and inverted for orientation downhole for releasing the ball into the axial bore 50.

In an embodiment, the supporting side 110 of the ball cartridge 70 can pass fluid therethrough while still supporting the ball 90. The supporting side 110 can be fit with one or more openings or passageways 120 that are smaller than the ball, but sufficient in size to permit flow of a fluid therethrough. Thus, a flow of fluid can be used to forcibly eject or positively displace balls 90 from the ball cartridge 70 when in its releasing position, in the event that ball 90 does not self-release from the axial bore 50 under the influence of gravity.

Figure 10C:
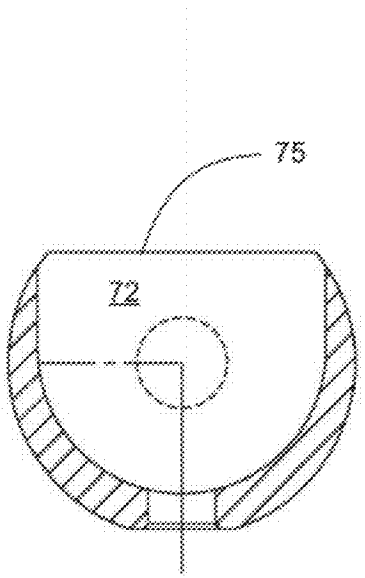
FIGS. 10A, 10B and 10C are illustration of a ball cartridge.

In another embodiment, as shown in FIG. 10C, to assist with inrush and outrush of fluid between axial bore 50 and the radial bore 60 during movement of the ball cartridge 70, the cartridge can be provided with some form of relief profile 75, increasing clearance between the ball cartridge 70 and its radial bore 60 to ease the passage of fluid thereby.

In another embodiment, the ball cartridge 70 can be adapted to sequentially receive and release a plurality of balls (not shown). The ball cartridge 70 can be segmented, or there can be more than one ball cartridge 70 in a radial bore to receive and release balls. Accordingly, an associated actuator 80 can be indexed to allow stepwise or incremental movement along the radial bore to release a first ball and then a subsequent ball.

Further, in another embodiment, balls may be loaded by installation of the ball cartridge, having a ball therein, as the actuator is being fastened to the radial housing 40. In another embodiment, the radial bore may be fit with a transverse passage (not shown) used to load balls when the cartridge is within the radial bore.

Figure 10B:
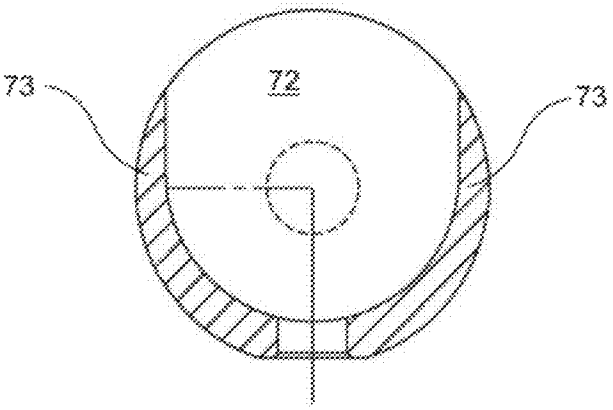
Figure 10A:
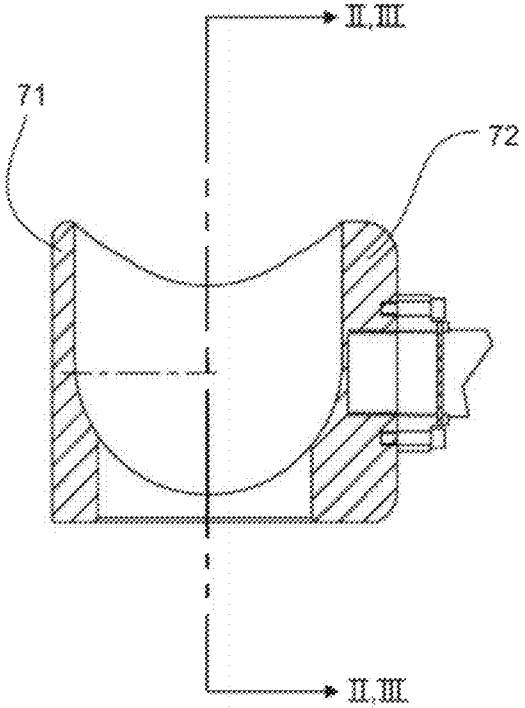

The ball cartridge 70 can be of a single size or can be of any suitable size that can accommodate balls of various diameters. The embodiments shown in the drawings, and more particularly in FIGS. 10A and 10B, illustrate a universal ball cartridge 70 of a cylindrical, rectangular or square shape and of a single size, but a person of ordinary skill in the art would understand that the ball cartridge 70 can be of any shape and one or more sizes so long as they are compatible with their respective bores, such as for rotation therein, and alternately receive and release balls.

The ball cartridge 70 is movable along the radial bore 60 by the actuator 80 for operably aligning or misaligning the ball cartridge 70 with the axial bore 50. The ball cartridge 70 has a rotational axis RA transverse to the axial bore 50 so that the open side 100 can be rotated to face uphole in its receiving position for loading a ball (see FIG. 4A) and downhole for releasing a ball (see FIG. 4D).

The actuator 80 can be operated manually or remotely. The ball cartridge 70 is fit to an inner distal end of a piston rod 130 and is mounted for co-rotation with the piston rod 130. One form of actuator is a double-acting hydraulically-actuated ram or cylinder 128 having a piston 129 and piston rod 130, the rod being connected to the ball cartridge 70. A person skilled in the art would understand that such a hydraulic remotely operated actuator 80 would require a first extension hydraulic line for extending the actuator rod and ball cartridge 70 into the axial bore 50, and a second retraction hydraulic line to retract the ball cartridge 70 into its radial bore 60. In one embodiment, each actuator would have its own hydraulic extension line for individualized operation. Each actuator can having its own hydraulic retraction line again or individualized operation.

In another embodiment, and with reference to FIG. 14, each actuator 80 again has its own hydraulic extension line 501, 502, 503 for individualized operation, yet each retraction line 510 would share a common hydraulic line 510, 510 with every other actuator 80 in the injector 10. Accordingly, when one retraction line 510 is energized to retract the last extended actuator 80, all of the shared retraction lines are energized ensuring all actuators 80,80,80, and correspondingly all ball cartridges 70, are retracted into their respective radial bores 60. This ensures that the axial bore 50 will remain clear and unobstructed as well as prevent collision of ball cartridges 70 within the axial bore 50.

In one embodiment, the ball cartridge 70 is locked to the piston rod 130 for co-rotation therewith to ensure co-rotation of the ball cartridge and piston rod 130. When threaded together, such locking can be with a locknut or castellated nut and cotter pin. In another embodiment, the ball cartridge 70 and the piston rod 130 can be a unitary piece.

The piston rod 130 is rotatable within the actuator 80. At an outer distal end of the piston rod 130, a handle or indicator 140 is mounted for co-rotation and co-movement therewith. The piston rod 130 reciprocates within the radial bore 60, moving inwardly towards the axial bore 50 or outwardly away from the axial bore 50. As the piston rod 130 reciprocates, so to does the indicator 140, indicating the relative location of the ball cartridge 70 in the radial bore 60 (see FIGS. 5A and 5B).

In the embodiment shown in FIGS. 5A to 5D, the indicator 140 can also have an arrow 150 to indicate the orientation of the open side 100 of the ball cartridge 70. In the ball cartridge's 70 standby position, the open side 100 of the ball cartridge 70 would be oriented to face uphole, and thus the direction of the arrow 150 on the indicator 140 would point uphole. Similarly, when the ball cartridge 70 is in its releasing position (see FIG. 4D), the open side 100 would be oriented to face downhole and thus the direction of the arrow 150 would point downhole and coincide with calibrations (not shown) on the actuator 80 to confirm that the ball cartridge 70 has been fully extended and is in alignment with the bore 50

In the embodiments illustrated in FIG. 4A to 4D, the actuator 80 can also include a U-shaped or slotted frame 160 for maintaining the orientation of the ball cartridge 70 by constraining the indicator 140 within a track or slots. Once the indicator 140 is placed in the U-shaped frame 160, the indicator 140 is rotational restrained by the frame 160, preventing the rotation of the indicator 140 and undesirable change in orientation of the ball cartridge 70. An example of U-shaped track can be a slotted guide tube 170 having guide tube slots 180 for guiding and constraining the indicator 140 as shown in FIGS. 6A to 6F In contradistinction to the prior art apparatus of FIG. 1, rather than arranging all the balls in the axial bore, the present invention stores the balls 90 in at least one radial ball array having two or more radial bores 60 and introduces the balls 90 to the axial bore 50, through a top access point, as required and thus maintaining an open and unobstructed axial bore 50. Accordingly, there is no restriction to the order in which the balls are loaded for use.

The balls can be loaded in any order, however to avoid errors, a sequential loading is likely to be implemented by operational personnel. The injector 10 could be pre-loaded before installation to the wellhead 20. Otherwise, if already installed, the injector 10 is isolated from the wellhead 20, such as by a remote gate valve 210 (shown in FIGS. 7A and 8) or wellhead gate valve and then loaded. Loading of the balls can also be done in dry conditions, or in a fluid environment. That is, if the loading of the balls is performed when the radial ball injector 10 is not installed on the wellhead 20, the loading of the balls are dry, without the presence of any fracturing fluid. However, if the loading of the balls is performed when the injector 10 is installed on the wellhead, fracturing fluid may be present in the injector 10. If there is fluid in the ball injector 10, the fluid can be vacuum removed or alternately, a calibration dip stick device (not shown) used to confirm that the ball is fully seated in the ball cartridge prior to misalignment.

In an embodiment, the injector 10 can be pre-loaded by removing the ball cartridges 70 from each housing 40, seating or receiving balls into each ball cartridge 70, and then reinstalling the loaded ball cartridges 70 on each radial housing 40.

In another embodiment, the radial housing 40 can have access ports (not shown) dedicated to loading balls while the ball cartridges 70 are retracted within its respective radial bore 60.

Figure 7A:
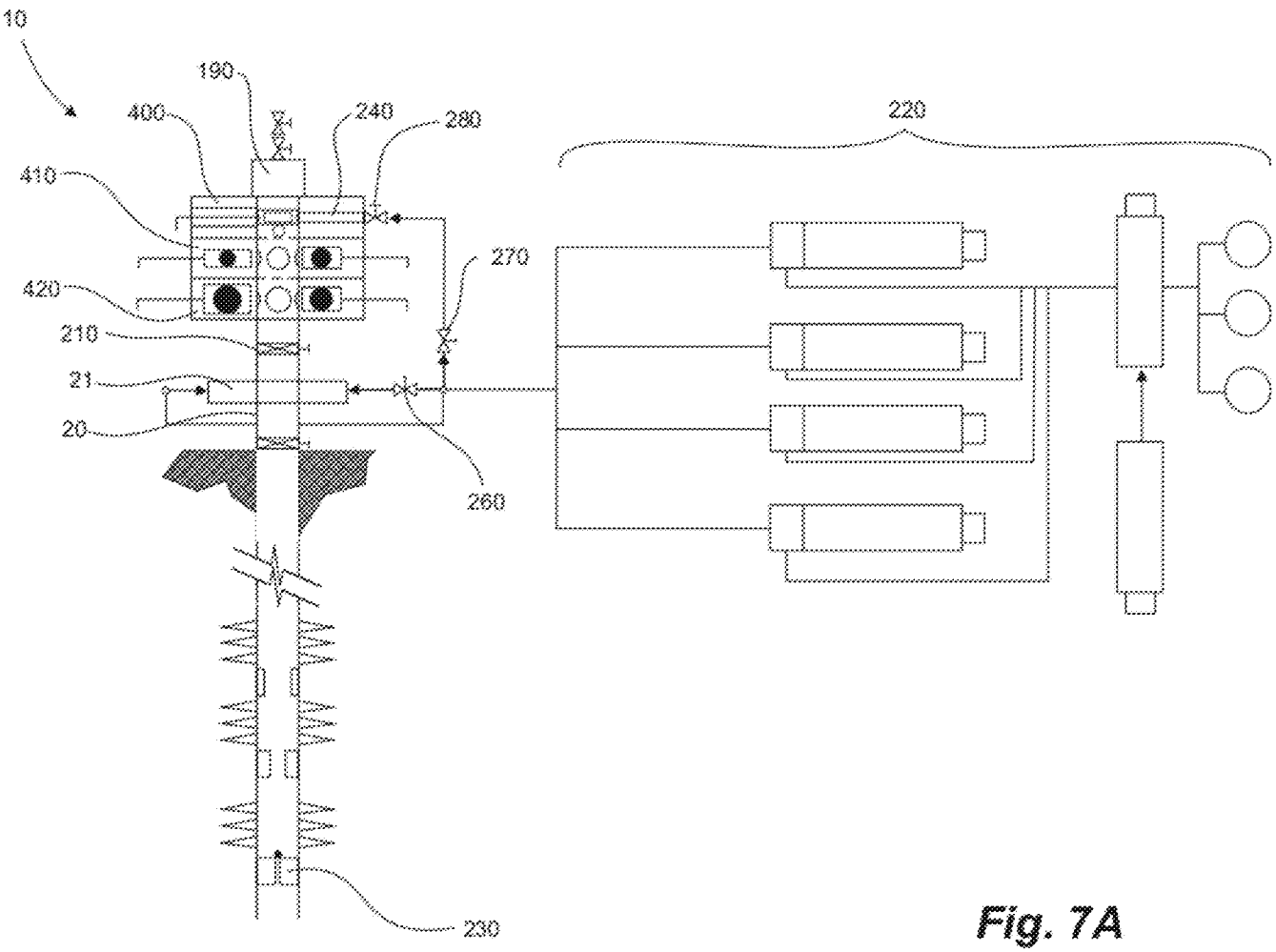
FIG. 7A is a schematic side view of a well undergoing stimulation operation using an embodiment of the present invention having three radial housings vertically stacked one on top of another and connected to the wellbore, pumpers, and associated equipment shown in plan view.

As shown in FIGS. 2, 7A, and 8, the radial housing 40 can be fit with a top access port 190 and an access valve 200, such as a T-valve. Each ball cartridge 70 is sequentially actuated one by one to its receiving position, aligning the ball cartridge 70 with the axial bore 50 with its open side 100 oriented uphole.

Referring back to FIGS. 6A to 6F, and FIGS. 4A to 4D, the indicator 140 can be actuated to move the piston rod 130 towards the axial bore 50, causing alignment therewith. In one embodiment, the indicator 140 can be guided by the guide tube 170 having guide tube slots 180.

After the ball cartridge 70 is in alignment with the axial bore 50, and confirmed by the direction of the arrow 150 that the open side 100 of the ball cartridge 70 is facing uphole, a ball 90 is dropped into the axial bore 50 through the top access port 19. Once ball 90 is seated within the ball cartridge 70, the ball cartridge 70 is withdrawn into its radial housing 40 (see FIGS. 4B and 6C) to store and secure the ball 90 for therein, preventing premature and accidental release of the ball into the axial bore 50. In one embodiment, the ball cartridge 70 can be rotated 180 degrees into its standby position (see FIGS. 6D and 6E), securing the ball 90 within its radial bore 60 (see FIG. 4C).

The indicator 140 is secured within the slots 180 of the guide tube 170 by a spring or a similar tension device 280. To fully rotate the ball cartridge from its position having the open side 100 oriented to face uphole to its inverted position having the open side 100 oriented to face downhole, the indicator or handle 140 must be pulled out, temporarily overcoming the tension device 280, moved beyond the slots 180 of the guide tube 170, and then rotated 180 degrees, thereafter returning to engage the slots 180. The slots 180 of the guide tube 170 restrain free rotational movement of the indicator 140. Rotation of the ball cartridge 70 can only occur once the indicator 140 is beyond the slots 180 and free to rotate.

Figure 6B:
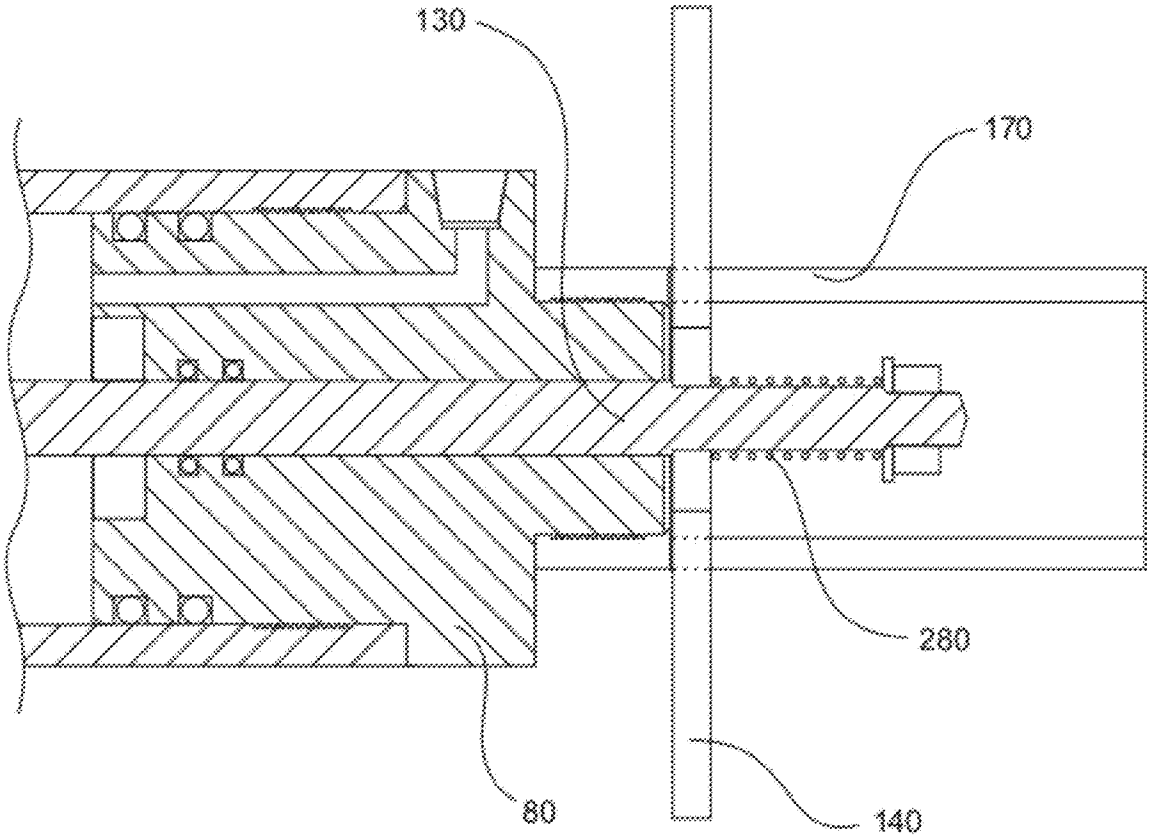
FIG. 6B is a partial cross-sectional side view of the actuator in FIG. 6A illustrating the position of the indicator, and orientation of the arrow when the ball cartridge is in its receiving position and in alignment with the axial bore.
Figure 6C:
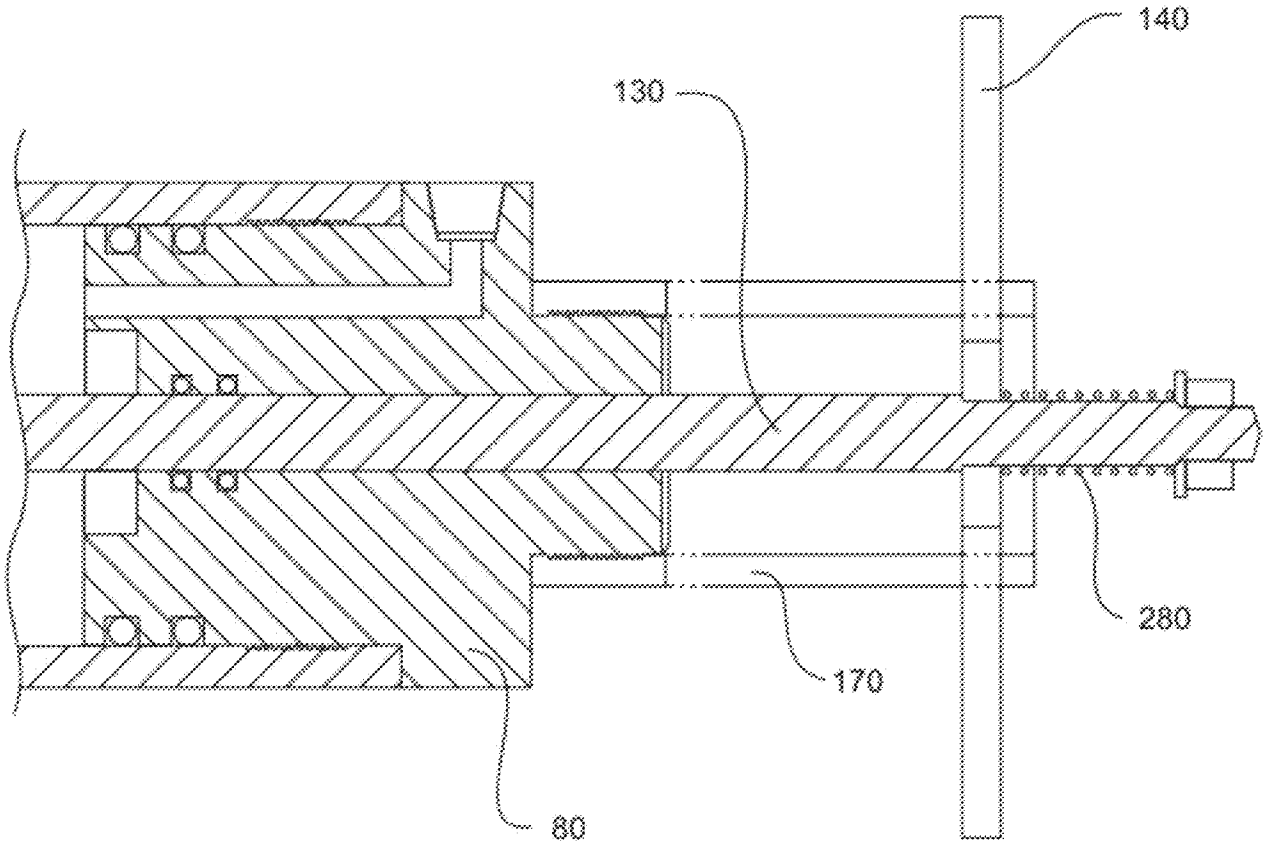
FIG. 6C is a partial cross-sectional side view of the actuator in FIG. 6B illustrating the position of the indicator and orientation of the arrow after a ball has been received and the ball cartridge is actuated to be misaligned with the axial bore and retracted into the radial bore.
Figure 6D:
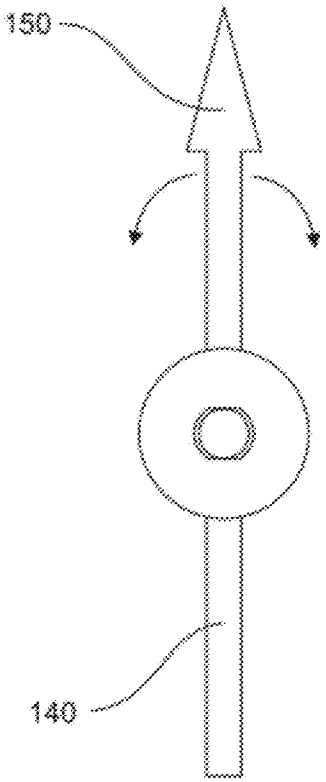
FIG. 6D is a partial cross-sectional side view of the actuator in FIG. 6C illustrating the indicator being pulled out beyond slots in a guide tube allowing the indicator to be rotated.
Figure 6D:
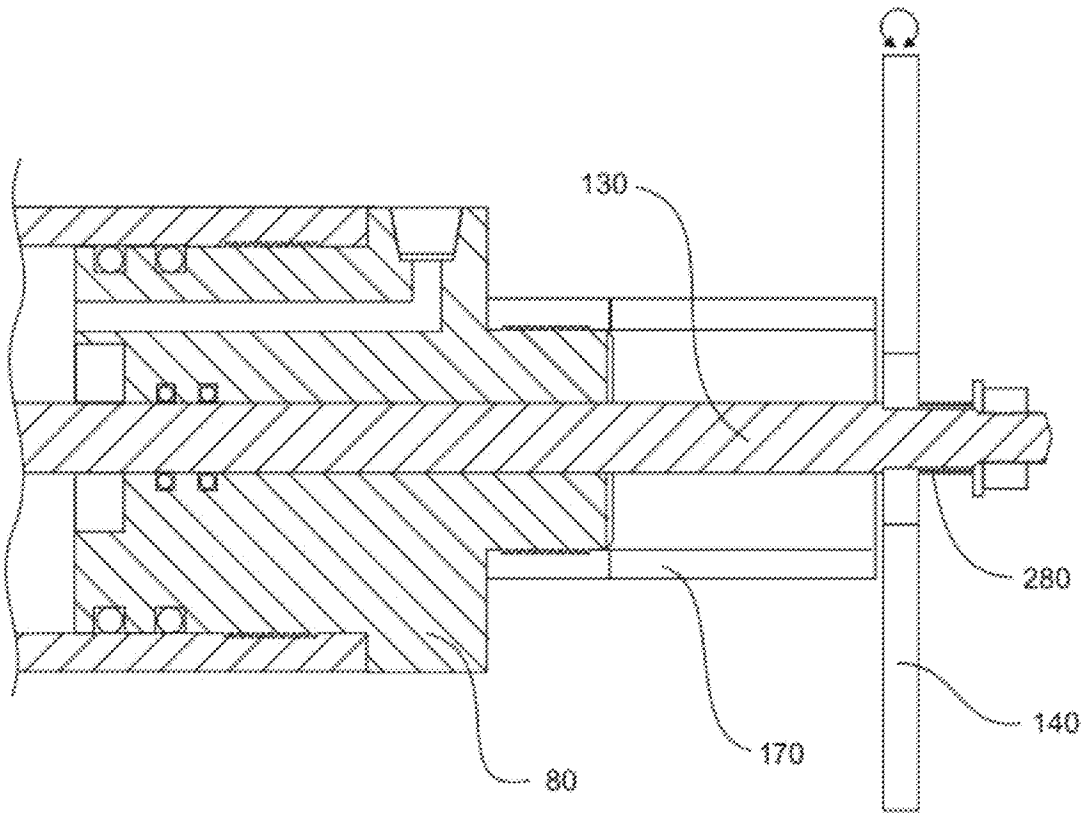
Figure 6E:
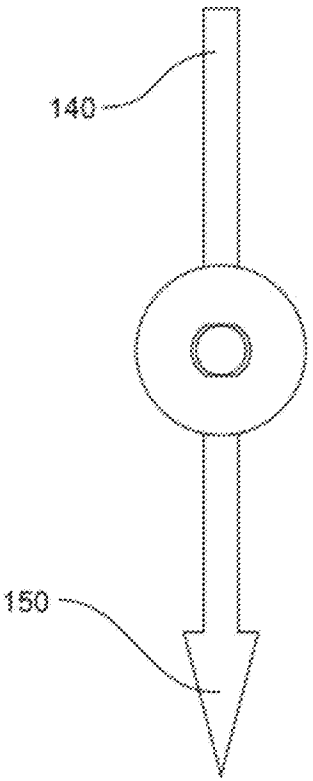
FIG. 6E is a partial cross-sectional side view of the actuator in FIG. 6D illustrating the indicator and arrow when the ball cartridge is in its standby position, being oriented to face downhole.
Figure 6E:
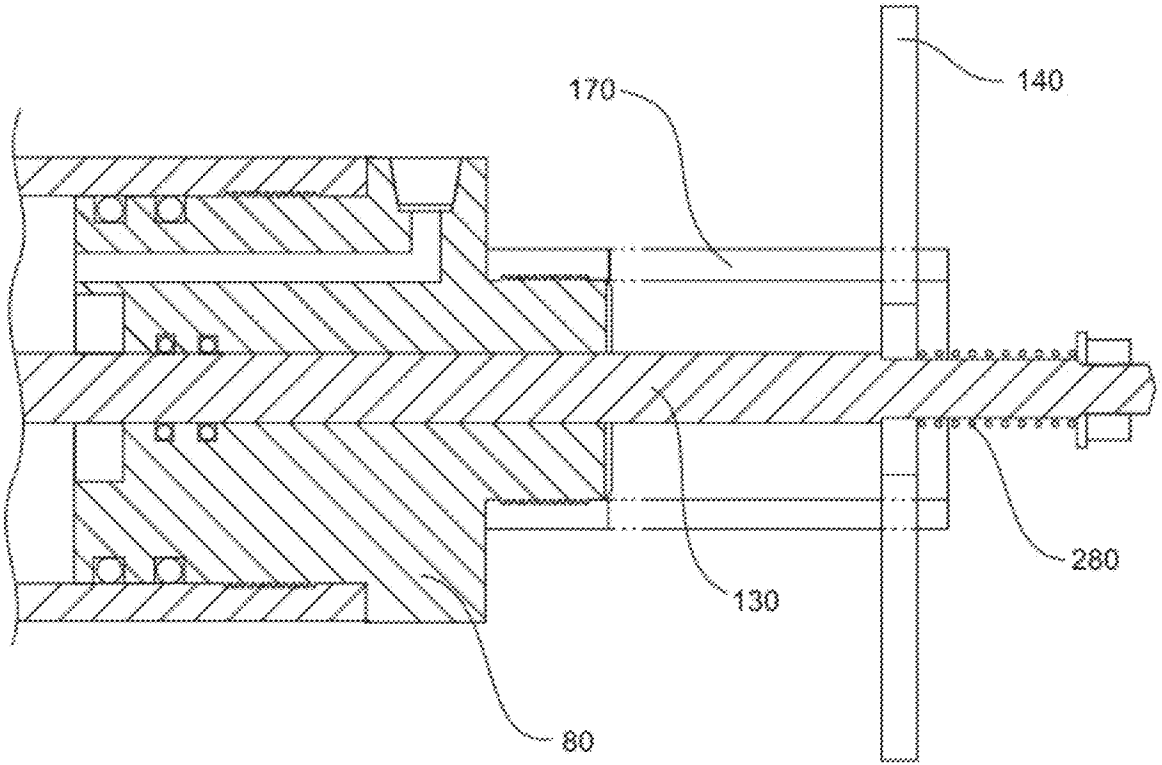
Figure 6F:
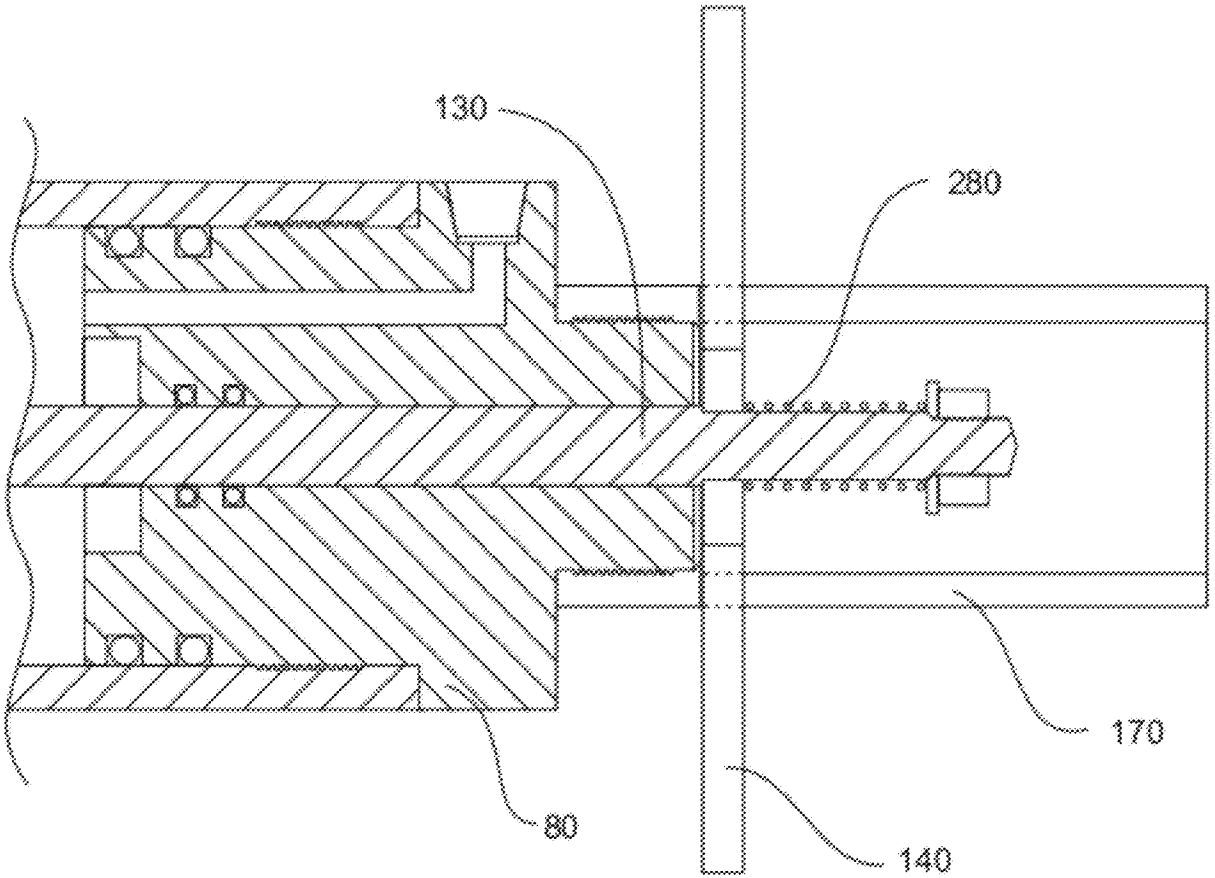
FIG. 6F is a partial cross-sectional side view of the actuator in FIG. 6F illustrating the indicator and arrow when the ball cartridge is in its releasing position, being oriented to face downhole.

Each ball cartridge 70 is similarly loaded and is now ready to be actuated into its release position for launching or releasing its ball 90 into the wellbore 30. With reference to FIGS. 4D and 6F, to launch or release a ball 90, the ball cartridge 70 is actuated to extend into and in alignment with the axial bore 50. In an embodiment, the arrow 150 can line up with calibrations on the actuator 80 to confirm full travel and proper alignment of the ball cartridge 70 with the axial bore 50. The open side 100 of the ball cartridge 70, already oriented to face downhole, allows ball 90 to simply drop into the wellbore 30 by the influence of gravity.

Figure 9A:
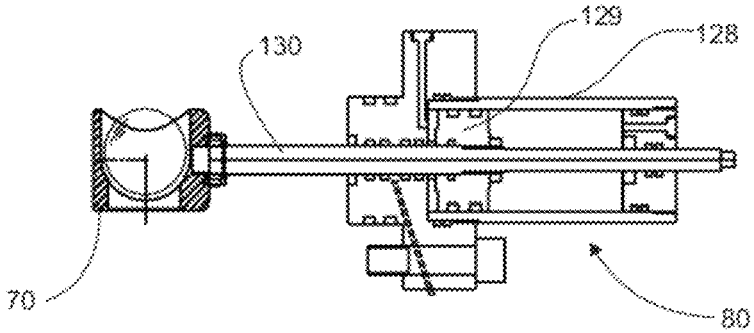
FIGS. 9A-9D are schematic representations of the sequence of events illustrating a ball cartridge being extended into and in alignment with an axial bore, the retraction of the ball cartridge, the rotation of the ball cartridge, and the extension of and realignment with the axial bore for releasing a ball.
Figure 9B:
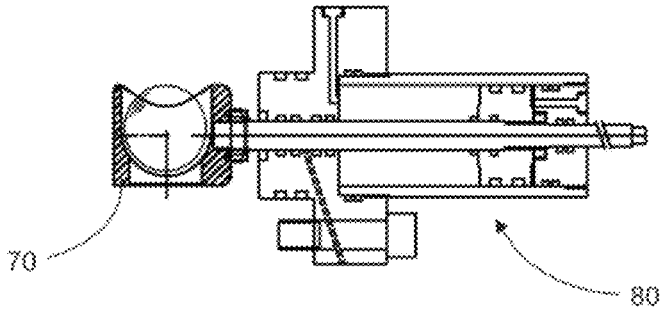
Figure 9C:
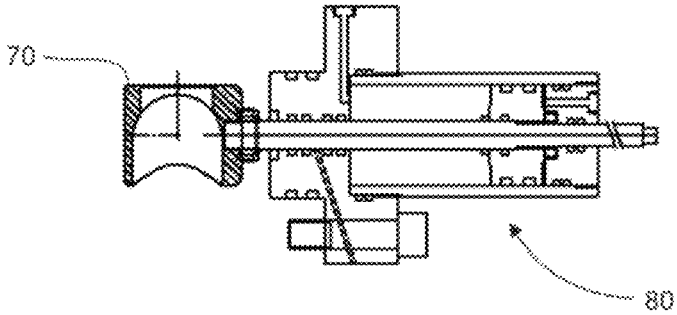
Figure 9D:
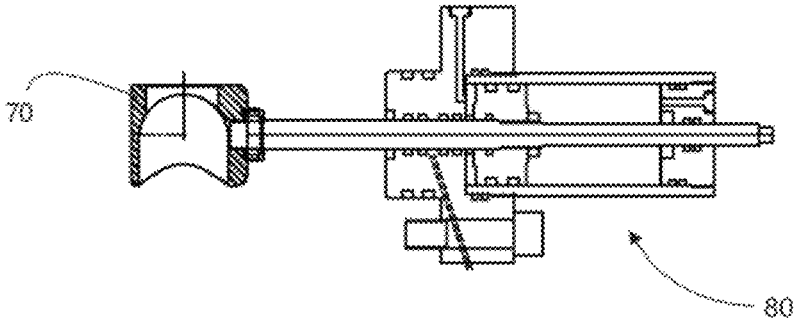

With reference to FIGS. 9A to 9D, a complete sequence of events for a particular ball cartridge is shown. FIG. 9A illustrates the ball cartridge extended for operable alignment with the axial bore for receiving a ball. The ball cartridge is oriented such that the open side of the ball cartridge is facing uphole. In FIG. 9B, the ball cartridge is shown to be withdrawn and retracted. The retraction of the ball cartridge causes misalignment of the ball cartridge with the axial bore, clearing the axial bore of all obstructions. Retraction of the ball cartridge into the radial bore also prevents the premature and accidental release of the ball into the axial bore during wellbore operations. FIG. 9C illustrates the 180 degree rotation of the ball cartridge into its standby position. FIG. 9D illustrates the ball cartridge in its releasing position, having been extended for alignment with the axial bore. Once in alignment, the ball, under the influence of gravity, can simple fall into the wellbore or can be positively displaced by either fracturing fluid or clean displacement fluid.

Other than the specific operational requirements of the downhole apparatus such as packers, there is no restriction upon which order the balls are dropped. However, for the exemplary operations discussed herein, the sequence is to drop the balls from small to large.

Figure 11:
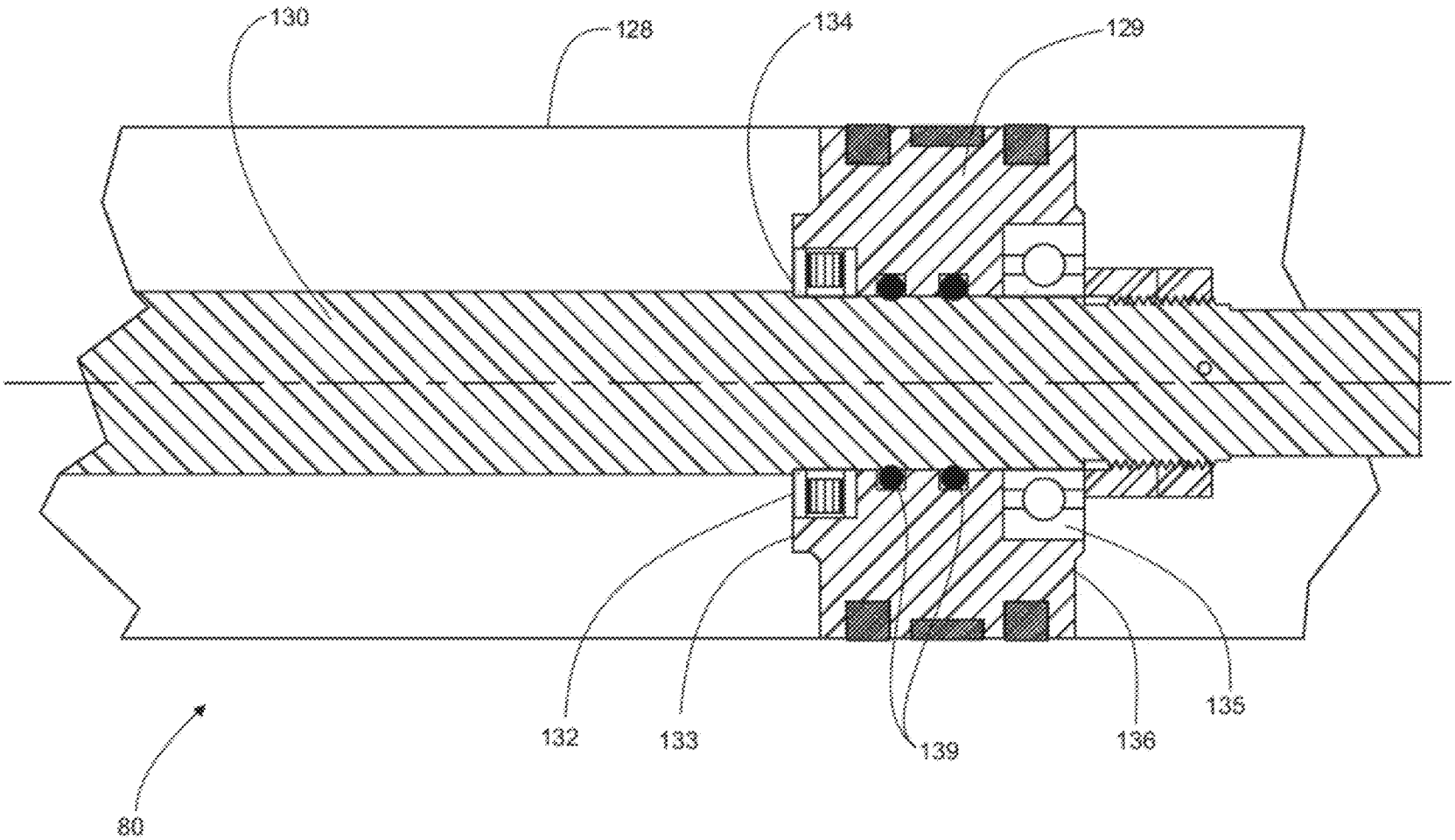
FIG. 11 is a partial cross-sectional drawing of a double acting cylinder form of an actuator of an embodiment of the present invention illustrating the piston, a portion of the piston rod and bearings used to facilitate the rotational movement of a piston rod relative to the piston itself.
Figure 12C:
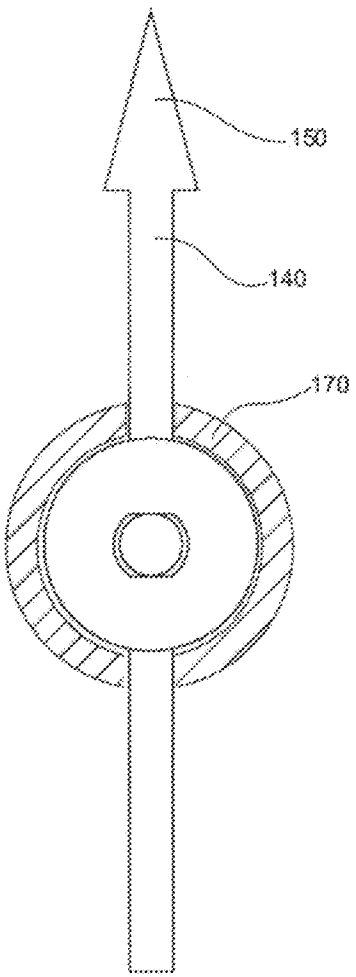
FIGS. 12A, 12B and 12C are stepwise schematic representations of the slotted guide tube, a compatible indicator and the indicator coupled and rotationally constrained by the guide tube slots.
Figure 12B:
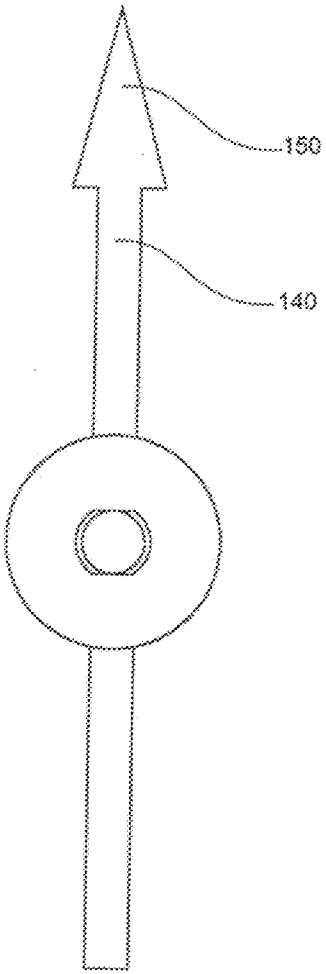
Figure 12A:
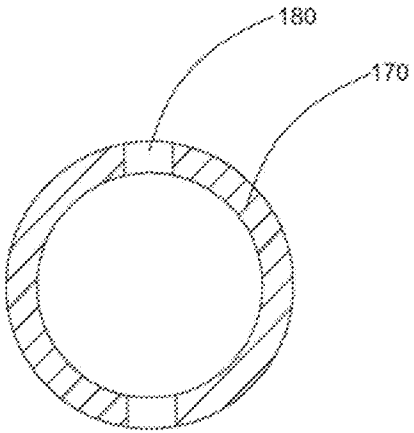
Figure 13C:
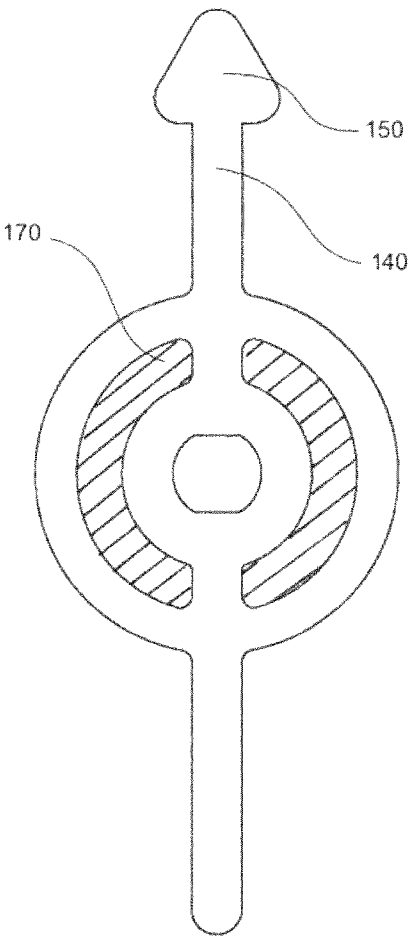
FIGS. 13A, 13B and 13C are stepwise schematic representations of the slotted guide tube, a compatible indicator of increased structural strength and the indicator coupled and rotationally constrained by the guide tube slots.
Figure 13B:
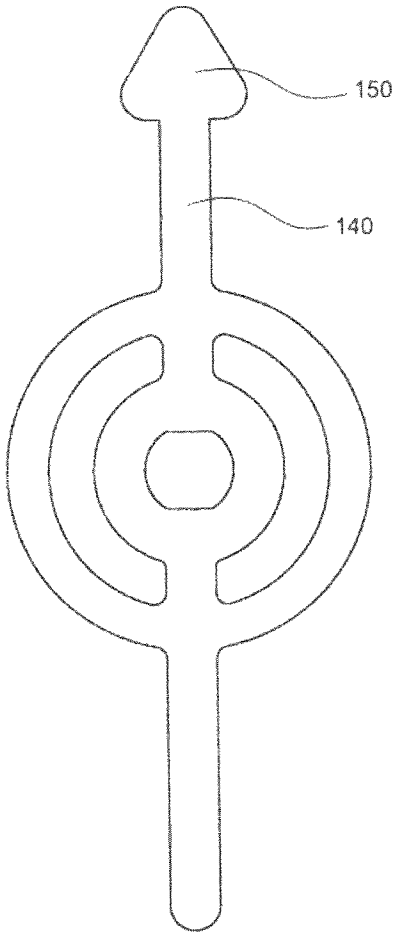
Figure 13A:
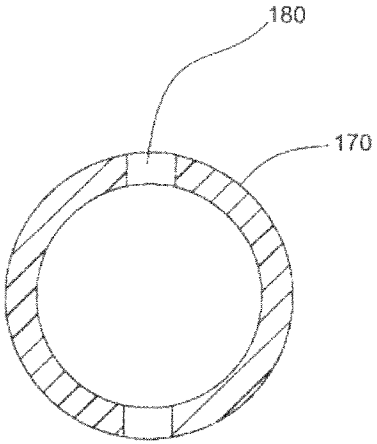

With reference to FIG. 11, another embodiment of the invention eases operations under the high pressures of various wellbore operations. As discussed, the actuator 80 can be a double-acting hydraulic cylinder. The piston rod 130 is double-extending, protruding from one end of the cylinder 128 to support the ball cartridge 70 and, as discussed below, protruding from the other to support an indicator. Conventionally, a piston rod is affixed to a piston, and it is known that a piston rod may occasionally be rotated, also requiring rotation of the piston within the cylinder. This means that a circumferential piston seal moves relative to the cylinder. While operable, other arrangements are disclosed herein.

Herein, the ball cartridge 70 is mounted to the axial bore end of the piston rod 130 for exposure to the axial bore 60 which can be at high pressures. Accordingly a hydraulic actuator is actuated via hydraulic fluid pressure in the cylinder 128 acts on the cylinder piston 129 to drive the piston rod 130 and ball cartridge 70 into the axial bore 50. The force at the piston 129 overcomes the fluid resisting force (fluid pressure× the area of the piston rod). For example, with fracturing fluid pressure at 10,000 psig and a piston rod 130 of one sq. inch, the force is 10,000 pounds. For a net piston 129 fluid area of nine sq. inches, the balancing hydraulic pressure would be 1,111 psi. In one embodiment, the ball cartridge 70 is rotated to the standby position before pressuring up the axial bore 50, and in other embodiments, it may be desirable to rotate the ball cartridge 70 under pressure. If so, implementation of rotatable piston rod 130 eases the effort required for rotation and enables reduced mechanical involvement of seals at the piston 129.

Accordingly, in an embodiment of the actuator, one or more bearings are provided at the piston 129 of a hydraulic cylinder actuator 80. The piston rod 130 is rotatable in the piston 129. A trust bearing 132, such as a cylindrical roller thrust bearing, is provided at an inner, axial bore facing side 133 of the piston. The piston rod 130 is formed with a shoulder 134 for axially supporting the piston rod 130 on the thrust bearing 132. An axial bearing 135, such as a ball bearing, is fit to the piston 129 between the piston 129 and the piston rod 130, such as at an outerward facing side 136 of the piston 129. The piston rod 130 is therefore rotatable within the piston 129, with the axially imposed force of fluid pressures rotatably restrained at the thrust bearing 132. With relative movement between the piston 129 and rod 130, seals 139 are provided therebetween to seal the hydraulic fluids.

In Operation

The apparatus above enables a successive dropping of balls into a wellbore dependent on the particular operations. A radial ball injector is provided for connection to the wellbore. The ball injector has at least one radial ball array having two or more radial bores extending radially away from the axial bore and in fluid communication therewith, the axial bore being in fluid communication and aligned with the wellbore. A ball is stored in each of two or more of the radial bores and with the ball misaligned from the axial bore. In operation, a ball is actuated from one of the two or more radial bores for operably aligning the ball with the axial bore for release down the axial bore for eventual dropping into the wellbore. As operations dictate, one repeats the actuating of a successive ball from each other of the two of more radial bores for release and dropping into the wellbore.

With reference to FIGS. 7A to 7D, and in more detail and shown in the embodiment in FIG. 7A, fracturing fluids are provided to a frac head 21 atop a wellhead 20. A radial ball injector 10 having three radial housings 400,410,420, is fit to the frac head 21 and has a remotely actuable gate valve 210 therebetween. Fracturing fluid pumpers and equipment 220 provide fracturing fluid for stimulation operations to a zone above a recently blocked packer 230.

In a fracturing operation, high pressure fluids are utilized. Embodiments of the invention minimize personnel exposure to hazardous areas particularly about the wellhead 20. Features include the remotely actuated gate valve 210 and remote actuation of radial ball arrays of radial housing 400,410,420 to release their respective balls. Other steps in the operation, which place personnel in close proximity to the wellhead 20, can occur prior to pressuring up or at least the ball injector 10 being de-pressurized.

In the embodiment shown in FIG. 7A, the radial ball injector 10 comprises three radial housings, an uppermost radial housing 400, a middle radial housing 410, and a lowermost radial housing 420, vertically stacked one on top of another.

Each radial housing 400, 410, 420 has a radial ball array having two or more radial bores, most of which store a ball, related ball cartridges and actuators.

Figure 7B:
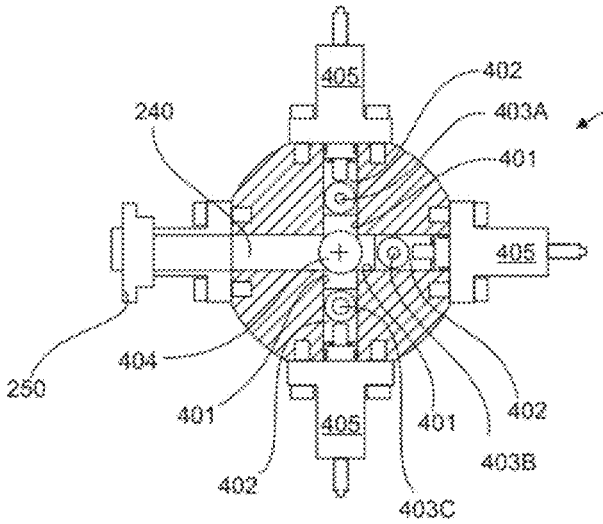
FIG. 7B is a cross-sectional top view of the uppermost radial housing of the embodiment in FIG. 7A illustrating a three radial bore embodiment fit thereto for a smaller ball implementation with a (optional) fourth radial bore for access or depressurization service.

With reference to FIG. 7B, the uppermost radial housing 400 has a radial ball array of three radial bores 401, 401, 401 for balls and one auxiliary port 240 fit with a hammer union for installation of a bleed valve 250 and optional ball pumping fluid line (not shown). The three radial bores 401, 401, 401 contain ball cartridges 402, 402, 402 respectively for storing balls 403A, 403B, 403C. The three radial bores 401, 401, 401 and the auxiliary port 240 are fluidly connected to axial bore 404. For the purposes of this example operation, ball 403A is the smallest, ball 403B is successively larger than ball 403A, and ball 403C is the largest of the three balls in the uppermost radial housing 400.

Figure 7C:
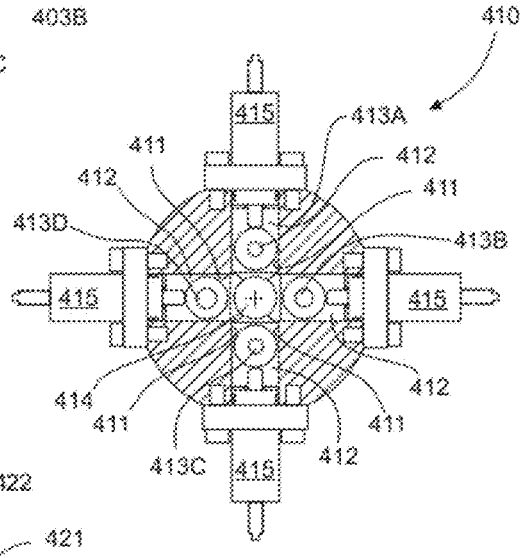
FIG. 7C is a cross-sectional top view of the middle radial housing of the embodiment in FIG. 7A illustrating a four radial bore embodiment.

As shown in FIG. 7C, the middle radial housing 410 has a radial ball array of four radial bores 411, 411, 411, 411 containing four ball cartridges 412, 412, 412, 412 for storing balls 413A, 413B, 413C, 413D. Middle radial housing 410 might be the same as the uppermost radial housing 400.

The four radial bores 411, 411, 411, 411 are fluidly connected to axial bore 414. Similar to the balls of the uppermost radial housing 400, the balls in the middle radial housing 410 are successively larger, with ball 413A being the smallest of the four and ball 413D being the largest. However, ball 413A is larger than ball 403C of the uppermost radial housing 400.

Figure 7D:
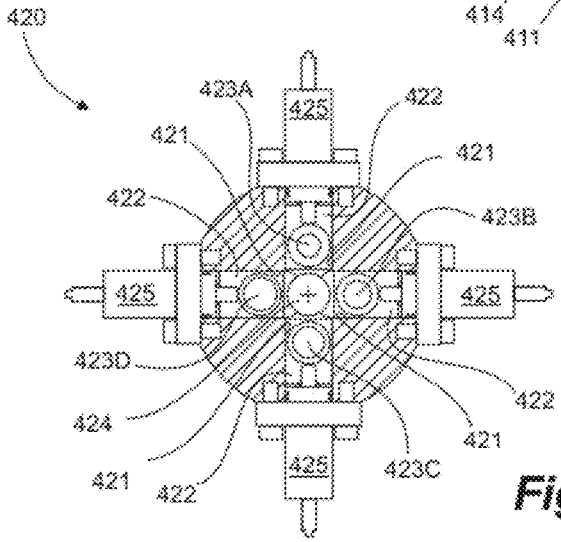
FIG. 7D is a cross-sectional top view of the lowermost radial housing of the embodiment in FIG. 7A illustrating a four radial bore embodiment.

FIG. 7D illustrates the lowermost radial housing 420, also having a radial ball array of four radial bores 421, 421, 421, 421 containing ball cartridges 422, 422, 422, 422 for storing balls 423A, 423B, 423C, 423D. The lowermost radial housing 420 might incorporated with the middle radial housing 410 or with both the middle and uppermost radial housings 410,400.

The four radial bores 421, 421, 421, 421 are fluidly connected to axial bore 424. Once again ball 423A is the smallest of the four, while ball 423D is the largest. However, ball 423A is larger than ball 413D of the middle radial housing 410.

With the ball injector depressurized, before or after installation to the wellhead 20, to load ball 403A, a first ball cartridge 402 of the uppermost radial housing 400 is actuated to extend into its receiving position and in alignment with the axial bore 404. Ball 403A is dropped into axial bore 404 through top access port 190 and is received by the first ball cartridge 402. Once ball 403A is loaded, ball cartridge 402 is retracted into its radial bore and clears the axial bore 404. The cartridge 402 can be rotated 180 degrees within its respective radial bore 402 and into its standby position, having the cartridge's open side 100 oriented to face downwardly. The ball 403A remains within the radial bore 402.

With the assistance of FIGS. 4A through 4D, the rotating handle or indicator 140 is physically and rotationally secured in position by guide tube 120 having guide tube slots 140 to maintain ball cartridge 402 orientation.

The remaining ball cartridges 402, 412, 422 are similarly loaded for each radial housing 400, 410, 420.

As stated, the open side of the ball cartridges can be rotated to face downwardly during the loading process. Alternatively, the ball cartridges can remained oriented to have the open side facing uphole and only rotated just prior to releasing its ball. However, in this embodiment, the rotation is a manual process involving personnel. For safety reasons, all ball cartridges are manually rotated to have the open side of the ball cartridges oriented to face downhole just prior to commencement of wellbore operations and before pressuring up. In this way, personnel are always kept away from lines under high pressure, such as the hydraulic lines, and fracturing lines.

In embodiments where the ball cartridges can be rotated remotely, the ball cartridges could be stored in standby mode throughout operations, with their open side up, until just prior to release of its associated ball.

Returning back to FIG. 7A, after loading the balls, wellbore fracturing can commence. Fracturing fluid is flowed through the frac head by the pumpers 220 and at an appropriate time, the flow rate of the fracturing fluid is typically reduced and the smallest of the balls is released or launched.

To release the smallest ball 403A, a first actuator 405 corresponding to the ball cartridge 402 storing the smallest ball 403A is actuated, aligning its ball cartridge 402 with the axial bore 404. The indicator 140 is monitored to confirm that the open side 100 of ball cartridge 402 is facing downhole and the ball cartridge 402 has moved fully along its radial bore 401 and into axial bore 404 for release of ball 403A. In an embodiment, an operator can visually inspect the location of the indicator 140 and compare it to calibrations on the actuator to ensure that the ball cartridge 402 has completely traveled the length of the radial bore 401 and aligned with axial bore 404. Ball cartridge 402, facing downhole, allows ball 403A to simply fall under the influence of gravity. Displacement fluid, although not necessary, can be by-passed from the fracturing line or independently pumped by an auxiliary pumper to flow through the cartridge, displacing a stuck ball, and ensuring the ball enters the fracturing fluid mix.

Thereafter, ball cartridge 402 is retracted back into its radial bore 401 to clear the axial bore 404 for another ball in the uppermost radial housing 400.

The balance of the ball cartridges and actuators can be operated in sequence to introduce or release each successively larger, right sized ball at the correct time in the operation. As with all industry standard balls, ball 403A has a higher specific gravity than the fracturing fluid and falls through the wellbore 30 to the packer therebelow.

To ensure that a ball has either left its ball cartridge, or exited its axial bore to enter into the wellbore 30, a fluid can be pumped through the ball injector 10, such as through the auxiliary port 240 and axial bore 404 in the uppermost radial housing 400. A slipstream of fracturing fluid can be diverted and positively applied by actuation of a first remote valve 260 and a second remote valve 270 in the fracturing fluid lines from the pumpers 220. As shown in FIG. 7A, the second remote valve 270 to the auxiliary port 240 is opened and the first remote valve 260 to the frac head 20 is closed for providing a stream of fracturing fluid down the axial bore 50. In another embodiment, a third remote valve 280 can also be fluidly connected to the auxiliary port 240 to act as redundancy. Alternately, and as shown in FIG. 8, a separate ball pumper 320 could be connected, such as through a top access valve 200 above the axial bore 50 for delivery of a clean displacement fluid.

If implemented, the stream of fracturing fluid flowing down through the axial bore 404 passes through passageway 120 and forcibly causes or positively displaces the ball 90 to be released from the ball cartridge 70 to enter the fracturing fluid mix and the wellbore.

In another embodiment, such as during acid treatment of wellbores, balls can be released while the treatment fluid is being pumped through the injector 10.

If a ball were to fail or disintegrate due to the energy imparted thereto by the fracturing fluid, remote gate valve 210 between the frac head 21 and radial ball injector 10 can be closed, pressure bled off the radial housings via remote bleed valve 250 and a new ball loaded. The ball injector 10 need not be disassembled from the wellhead 20 to load a replacement ball as the balls are housed in the radial bores, and the axial bore of each radial housing remain open and free of any obstructions. This allows an operator to actuate the appropriate ball cartridge into its receiving position to receive and load a replacement ball. The balance of the balls remain and await actuation. In an alternate embodiment, a replacement ball can simply be dropped into the axial bore without loading the replacement ball into a ball cartridge.

The open and unobstructed nature of the axial bore further allows an operator to visually confirm if a ball has been deployed by opening the top access port 190 and looking down the axial bore 50 of the radial ball injector 10. This open and unobstructed nature of the axial bore obviates the need of stopping fracturing operations, removing the entire ball injecting apparatus 10 from the fracturing head, dropping a replacement ball, reassembling the injector 10, pressure testing the injector 10 and then re-starting fracturing operations.

In an alternate embodiment, and as shown in FIG. 8, a ball injecting apparatus or injector 500 has a radial housing 40 having two radial ball arrays 35 of two or more radial bores. The injector 500 further has a remote gate valve 210 positioned in between the ball injector 10 and the fracturing head 310. A separate dedicated pumping unit 320 with a fluid line 321 is fluidly connected to the ball injector 10 through the top access port 190 and access valve 200. Fracturing head 310 is fluidly connected to a series of pumping units (not shown) by fracturing fluid lines 311 (lines 311 shown schematically).

To launch a ball 90 during fracturing operations, the remote gate valve 210 is closed and an appropriate sized ball is launched by operably aligning a ball cartridge 70 with the axial bore 50, and allowing the appropriate sized ball 90 to drop onto the remote gate valve 210. The injector 10 can be pressured up to the operation pressure before opening the valve 210. Although simply opening the remote gate valve 210 would allow the ball 90 to enter the fracturing fluid mix and the wellbore under the influence of gravity, as a precaution, the dedicated pumping unit 320 can pump displacement fluid through the top access port 190 as the remote gate valve 210 is opened. The displacement fluid ensures a positive displacement of the ball 90 from its ball cartridge 70 and the ball injector 500, ensuring the ball 90 enters the fracturing fluid mix and the wellbore. Once the ball 90 enters the fracturing fluid mix, the remote gate valve 210 is closed. The displacement fluid can be nitrogen gas, or other clean fluids lacking abrasive material such as fracturing fluid absent sand. If the displacement fluid is sand-laden or otherwise contaminated, one should subsequently clean the injector as a precaution.

During winter operations, the clean displacement fluid can comprise methanol for lowering the freezing point of the fracturing fluid. Lowering of the freezing point of the fracturing fluid reduces icing issues within the ball injector 500 and the fracturing head 310. Clean displacement fluid also removes the potential for the deposition and erosion by contaminants, such as sand from sand-laden fracturing fluid, in the ball injecting apparatus 500.

This alternative embodiment and method allows the remote gate valve 210 to isolate the ball injector 500, between ball releases, from operational conditions including excessive fracturing pressures, sudden fracturing pressure spikes, and abrasive and corrosive fracturing materials, such as chemicals and sand, which may cause damage thereto.

The isolation of the ball injector 500 from the fracturing head 310 is also advantageous because it would allow operators to replace balls, make repairs or perform other operations without causing interruptions to the overall fracturing process.

In an alternate embodiment, for loading balls during adverse conditions such as nighttime, or storm conditions, or for loading when there is fluid in the axial bore, the loading of balls can be aided using a calibrated tubular or sleeve (not shown), which slides down the axial bore to engage an extended ball cartridge in its receiving position. The calibrated sleeve has calibrations along an upper outside periphery indexed for reference against a top surface of the radial housing or other convenient reference point so that the operator knows which radial housing is being loaded. Further, once a ball has been dropped down the sleeve and into a cartridge, a calibrated dip stick can be used to ensure that the ball is the correct ball and is in proper registration with the radial housing and correct ball cartridge.

Figure 14:
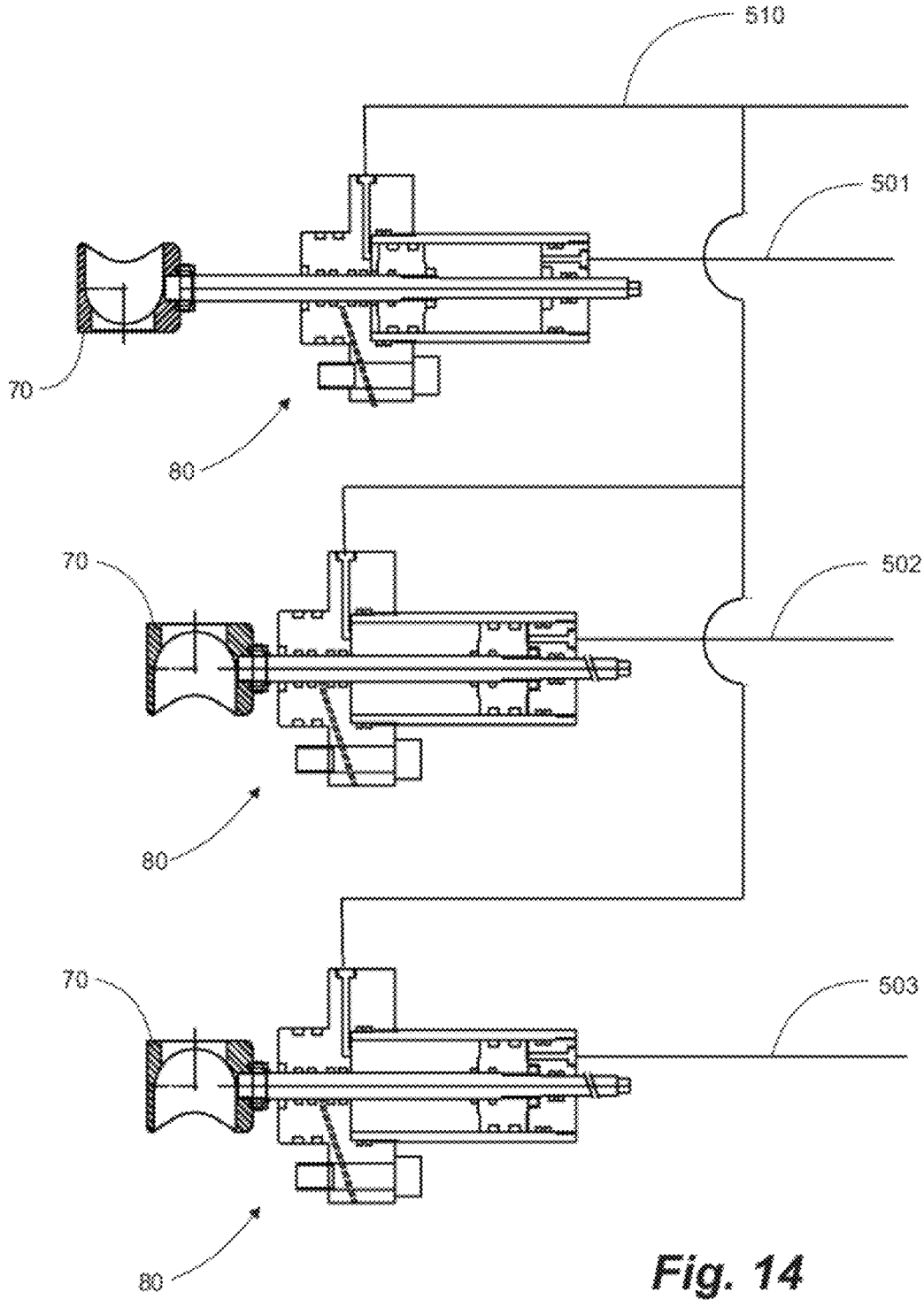
FIG. 14 is a schematic of three hydraulic actuators having individual extension lines and common retraction lines.

In an embodiment shown in FIG. 14, a single hydraulic retraction line 510 can be used instead of having multiple individual hydraulic lines for each individual actuator of the ball injector. The elimination of multiple hydraulic retraction lines for the actuators simplifies operation and reduces the number of high pressure lines in an operational area. As stated above, the use of a single hydraulic return line also ensures that the axial bore is fully clear and unobstructed, eliminating the potential of having one aligned ball cartridge from jamming into another aligned ball cartridge.

In another embodiment, a control panel with a lever for the actuators can include manual hydraulic fluid isolation valves to avoid accidental actuation. Safety tabs can further be installed to prevent accidental actuation and counter balance valves can be installed for each actuator to prevent actuation in cases where there is a hydraulic fluid leak in the actuator.

In another embodiment, the injector is capable of refurbishment by removal of one or more of the actuators, replacement of the seals, bearings and components such as cartridges.

The embodiments of the invention in which an exclusive property or privilege is claimed are defined as follows:

1. A ball injecting apparatus for releasing balls into a wellhead having a wellbore comprising:

a housing adapted to be supported by the wellhead, the housing having an axial bore therethrough and at least one radial ball array having two or more radial bores extending radially away from the axial bore and in fluid communication therewith, the axial bore being in fluid communication and aligned with the wellbore; and each of the two or more radial bores having, a ball cartridge for storing a ball; and an actuator for moving the ball cartridge along the radial bore for operably aligning with the axial bore for releasing the stored ball and operably misaligning from the axial bore for clearing the axial bore.

2. The ball injecting apparatus of claim 1, wherein each ball cartridge further comprises an open side for releasing the ball and a supporting side for seating the balls.

3. The ball injecting apparatus of claim 2, wherein the ball cartridge further comprises a rotational axis for orienting the open side towards the wellbore.

4. The ball injecting apparatus of claim 2 wherein the supporting side of the ball cartridge further comprises a passageway for the flow of fluid therethrough.

5. The ball injecting apparatus of claim 2, wherein the open side is oriented to face uphole when the ball cartridge is in a ball-receiving position, and wherein the open side is oriented to face the wellbore when the ball cartridge is in a releasing position.

6. The ball injecting apparatus of claim 2, wherein the actuator further comprises an indicator for indicating a relative position of the ball cartridge between the aligned and misaligned positions.

7. The ball injecting apparatus of claim 6, wherein the indicator extends axially from the actuator.

8. The ball injecting apparatus of claim 6, wherein the indicator further indicates the orientation of an open side of the ball cartridge.

9. The ball injecting apparatus of claim 1 wherein the at least one radial ball array is two or more radial ball arrays.

10. The ball injecting apparatus of claim 6 wherein the actuator further comprises a track for guiding the indicator.

11. The ball injecting apparatus of claim 10, wherein the track rotationally constrains the indicator.

12. The ball injecting apparatus of claim 1 wherein the axial bore is otherwise unobstructed except when one of any one of the ball cartridges is operably aligned with the axial bore.

13. A method of successively dropping balls into a wellbore comprising:

providing a radial ball injector for connection to the wellbore, the ball injector having at least one radial ball array having two or more radial bores extending radially away from the axial bore and in fluid communication therewith, the axial bore being in fluid communication and aligned with the wellbore;

storing a ball in each of two or more of the radial bores with the ball operably misaligned from the axial bore, each ball being stored in a ball cartridge movable along its respective radial bore;

actuating a ball from one of the two or more radial bores for operably aligning the cartridge and the stored ball with the axial bore for release into the wellbore; and repeating the actuating of a successive ball from each other of the two of more radial bores.

14. The method of claim 13 wherein storing the ball misaligned from the axial bore comprises positioning the ball cartridge in the radial bore retracted from the axial bore.

15. The method of claim 13 wherein actuating the ball further comprises positioning the ball cartridge operatively aligned with the axial bore.

16. The method of claim 13 wherein prior to actuating the ball from the radial bore, further comprising rotating the ball cartridge to orient the ball towards the wellbore.

17. The method of claim 13 wherein the wellbore further comprises a valve, and actuating the ball further comprises:

operably aligning the ball with the axial bore for releasing the ball onto the valve; and opening the valve for releasing the ball into the wellbore.

18. The method of claim 13 wherein operably aligning the ball with the axial bore further comprises pumping fluid through the axial bore for positively displacing the ball down the axial bore.

* * * * *